US007601079B2

(12) United States Patent
Sullivan

(10) Patent No.: US 7,601,079 B2
(45) **Date of Patent: *Oct. 13, 2009**

(54) GOLF BALL WITH MULTIPLE COVER LAYERS

(75) Inventor: Michael J. Sullivan, Barrington, RI (US)

(73) Assignee: Acushnet Company, Fairhaven, MA (US)

( * ) Notice: Subject to any disclaimer, the term of this patent is extended or adjusted under 35 U.S.C. 154(b) by 99 days.

This patent is subject to a terminal disclaimer.

(21) Appl. No.: 11/505,390

(22) Filed: Aug. 17, 2006

(65) Prior Publication Data

US 2006/0276265 A1 Dec. 7, 2006

Related U.S. Application Data

(63) Continuation of application No. 10/167,744, filed on Jun. 13, 2002, now Pat. No. 7,427,243.

(51) Int. Cl.
*A63B 37/12* (2006.01)

(52) U.S. Cl. ..... 473/378

(58) Field of Classification Search ..... 473/378, 473/370, 376, 377

See application file for complete search history.

(56) References Cited

U.S. PATENT DOCUMENTS

| | | | | |
|---|---|---|---|---|
| 3,147,324 | A | 9/1964 | Ward | 264/254 |
| 3,239,228 | A | 3/1966 | Crompton | 273/218 |
| 4,123,061 | A | 10/1978 | Dusbiber | 273/220 |
| 4,431,193 | A | 2/1984 | Nesbitt | 273/235 R |
| 4,692,497 | A | 9/1987 | Gendreau et al. | 525/263 |
| 4,884,814 | A | 12/1989 | Sullivan | 273/235 R |
| 4,919,434 | A | 4/1990 | Saito | 273/235 R |
| 5,006,297 | A | 4/1991 | Brown et al. | 264/234 |
| 5,120,791 | A | 6/1992 | Sullivan | 525/196 |
| 5,252,652 | A | 10/1993 | Egashira et al. | 524/392 |
| 5,253,871 | A | 10/1993 | Viollaz | 273/228 |
| 5,314,187 | A | 5/1994 | Proudfit | 273/235 R |
| 5,324,783 | A | 6/1994 | Sullivan | 525/196 |
| 5,334,673 | A | 8/1994 | Wu | 273/235 R |
| 5,403,453 | A | 4/1995 | Roth et al. | 204/164 |
| 5,456,972 | A | 10/1995 | Roth et al. | 428/224 |

(Continued)

FOREIGN PATENT DOCUMENTS

GB 2291812 2/1966

(Continued)

OTHER PUBLICATIONS

U.S. Appl. No. 10/138,304, filed May 6, 2002, entitled Golf Ball Incorporating Grafted Metallocene-Catalyzed Blends.

(Continued)

*Primary Examiner*—Tom Duong
(74) *Attorney, Agent, or Firm*—Hanify & King, P.C.

(57) ABSTRACT

A golf ball having a core and two or more cover layers, wherein the multiple cover layers are formed from materials that are substantially the same composition with the same Shore hardness, but are modified in some way to alter the processing or performance characteristics of the golf ball, or the layers have the same Shore hardness and at least one cover layer is formed of a polymer blend including a polyurethane composition, and at least one cover layer is formed of a different polymer blend.

9 Claims, 1 Drawing Sheet

U.S. PATENT DOCUMENTS

| | | | | |
|---|---|---|---|---|
| 5,484,870 | A | 1/1996 | Wu | 528/28 |
| 5,492,972 | A | 2/1996 | Stefani | 525/196 |
| 5,658,670 | A | 8/1997 | Fukushi et al. | 428/421 |
| 5,683,312 | A | 11/1997 | Boehm et al. | 473/354 |
| 5,688,191 | A | 11/1997 | Cavallaro et al. | 473/373 |
| 5,697,856 | A | 12/1997 | Moriyama et al. | 473/374 |
| 5,704,853 | A | 1/1998 | Maruko et al. | 473/363 |
| 5,733,428 | A | 3/1998 | Calabria et al. | 264/134 |
| 5,803,831 | A | 9/1998 | Sullivan et al. | 473/374 |
| 5,827,133 | A | 10/1998 | Chang | 473/370 |
| 5,885,172 | A | 3/1999 | Hebert et al. | 473/354 |
| 6,016,685 | A | 1/2000 | Ekstrom et al. | 73/9 |
| 6,117,024 | A | 9/2000 | Dewanjee | 473/351 |
| 6,117,025 | A | 9/2000 | Sullivan | 473/373 |
| 6,126,559 | A | 10/2000 | Sullivan et al. | 473/378 |
| 6,132,324 | A | 10/2000 | Hebert et al. | 473/378 |
| 6,149,535 | A | 11/2000 | Bissonnette et al. | 473/354 |
| 6,210,293 | B1 | 4/2001 | Sullivan | 473/374 |
| 6,217,464 | B1 | 4/2001 | Chang | 473/378 |
| 6,291,592 | B1 | 9/2001 | Bulpett et al. | 473/354 |
| 6,315,915 | B1 | 11/2001 | Hebert et al. | 216/67 |
| 6,394,914 | B1 | 5/2002 | Sullivan | 473/376 |
| 6,547,677 | B2 | 4/2003 | Sullivan et al. | 473/376 |

FOREIGN PATENT DOCUMENTS

| | | |
|---|---|---|
| GB | 2291817 | 2/1996 |
| WO | WO/0023519 | 4/2000 |
| WO | WO/0129129 | 4/2001 |

OTHER PUBLICATIONS

U.S. Appl. No. 09/775,793, filed Feb. 5, 2001, entitled "Wound Golf Ball Having Cast Polyurethane Cover".

U.S. Appl. No. 09/461,736, filed Dec. 16, 1999, entitled "Low Compression, Resilient Golf Balls Including An Organosulfur Catalyst And Method For Making Same".

U.S. Appl. No. 09/389,058.

First Ten Angstroms, Contact Angle Accuracy, Jun. 29, 1998.

GOLF BALL WITH MULTIPLE COVER LAYERS

CROSS-REFERENCE TO RELATED TO APPLICATIONS

This application is a continuation of U.S. patent application Ser. No. 10/167,744, filed Jun. 13, 2002, now U.S. Pat. No. 7,427,243, the entire disclosure of which is incorporated by reference herein.

FIELD OF THE INVENTION

This invention relates generally to golf balls having a center and at least one cover layers with an optional intermediate layer disposed therebetween. In particular, the invention relates to a multilayer golf ball with multiple cover layers having essentially the same hardness to combine the benefits of a harder, stiffer, more resilient ball with a softer, more responsive ball. More particularly, the invention relates to a golf ball with at least two covers, e.g., an inner cover and an outer cover, wherein the layers have the same Shore hardness, at least one cover layer is formed of a polymer blend including a polyurethane composition, and at least one cover layer is formed of a different polymer blend. The invention further relates to a golf ball having a core and two or more cover layers, wherein the multiple cover layers are formed from materials that are substantially the same composition with the same Shore hardness, but are modified in some way to alter the processing or performance characteristics of the golf ball.

BACKGROUND OF THE INVENTION

Conventional golf balls, solid or wound, typically have at least one core layer and at least one cover layer. Two-piece balls having a solid construction are popular with golfers because they provide a very durable ball with high initial velocity resulting in longer flight distance. Due to the rigidity of the materials used, however, the balls have a "hard" feel when struck with a club and a relatively low spin rate that makes them difficult to control, particularly on shorter approach shots.

Wound balls, i.e., spherical solid rubber or liquid center with a tensioned elastomeric thread wound thereon, are preferred by some golfers for a softer feel and higher spin enabling better control in and around the green. Wound balls typically travel a shorter distance, however, when struck as compared to a two piece ball. Moreover, as a result of their more complex structure, wound balls generally require a longer time to manufacture and are more expensive to produce than a conventional two piece ball.

Solid cores, used in wound or solid golf balls, are generally formed of a polybutadiene composition. In addition to one-piece cores, solid cores can also contain a number of outer layers, such as in a dual core golf ball. Covers, for solid or wound balls, are generally formed of ionomer resins, balata, or polyurethane, and can consist of a single layer or include one or more layers, such as a double cover having an inner and outer cover layer. The difference in play characteristics resulting from these different types of materials and constructions can be quite significant.

For example, ionomer-covered golf balls are typically harder than balata-covered golf balls, resulting in a more durable ball with a low spin rate. In contrast, balata-covered golf balls are less durable, but have a soft "feel" with high back spin for better control. Golf ball manufacturers have attempted to produce golf ball covers that provide the spin rate of balata with the cut resistance of an ionomer by forming various blends of materials. U.S. Pat. Nos. 4,884,814, 5,120,791, 5,324,783 and 5,492,972 disclose cover blends of high hardness and low hardness ionomers. However, none of the disclosed ionomer blends have resulted in the ideal balance of carrying distance, coefficient of restitution, spin rate and initial velocity that would approach the highly-desirable playability of balata-covered golf balls.

Other materials have been employed in golf ball covers in further attempts to provide a balata-like "feel" with an ionomer-like durability and distance. For example, polyurethane golf ball covers can be formulated to possess the softer "feel" of balata covered golf balls, such as disclosed in U.S. Pat. Nos. 3,147,324, 4,123,061, and 5,334,673. In particular, U.S. Pat. No. 5,334,673 discloses the use of two categories of polyurethane available on the market, i.e., thermoset and thermoplastic polyurethanes, for forming golf ball covers. Conventional golf ball covers made from polyurethane, however, have not fully matched ionomer-covered golf balls with respect to resilience or the rebound characteristics desirable to achieve the high initial velocity when stuck with a club.

In an attempt to provide golf balls that deliver the maximum performance in terms of both distance and spin rate for golfers of all skill levels, while still maintaining the desired aesthetic qualities discussed above, a number of golf ball manufacturers have introduced multilayer golf balls. The multilayer golf balls can include multiple cores, one or more intermediate layers, and one or more cover layers, wherein the layers can be formed of different or similar materials. U.S. Pat. No. 5,314,187 also relates to golf balls having a cover formed with multiple layers, wherein the outer layer, a blend of balata and elastomer, is molded over the ionomer resin inner layer. UK Patent Application Nos. GB 2,291,817 and 2,291,812 are both directed towards a wound golf ball with dual cover layers formed from balata or ionomer resins, wherein the inner cover layer has a high hardness as compared to the outer cover layer. U.S. Pat. No. 5,885,172 discloses a multilayer golf ball having an inner cover layer formed of a high flexural modulus material and a very thin outer cover layer formed of a castable, reactive liquid thermoset material. U.S. Pat. No. 6,210,283 discloses a double-layer cover using an ionomer inner cover and urethane outer cover.

Manufacturers have designed multilayer balls to have differences or similarities in the hardness of the layers of the ball to simulate the soft feel of balata, but still maintain the desirable properties of an ionomer resin cover. This difference in hardness can be accomplished through the use of substantially different materials in the different layers, or through the use of similar materials with various additives or differences in processing. For example, U.S. Pat. No. 6,132,324 discloses a multilayer golf ball having an high flexural modulus inner cover layer that is harder than the casted thermoset outer cover layer, while U.S. Pat. No. 4,431,193 relates to a multilayer cover having a hard, high flexural modulus ionomer resin inner layer and a soft, low flexural modulus ionomer resin. U.S. Pat. No. 6,117,025 discloses a three layer ball, wherein each layer has at least a three point difference in Shore D hardness and the intermediate layer is softer than at least one other layer of the ball. U.S. Pat. No. 6,126,559 discloses a soft core with a hard, thick cover of at least 60 Shore D in an attempt to provide a ball with distance and a comparable coefficient of restitution.

While the prior art has attempted to provide a golf ball having a soft feel, good spin, and distance through the use of a hard inner and soft outer cover, there exists a need in the art to provide such a ball using alternative methods with a dual cover or intermediate layer/cover combination, wherein the two layers have essentially the same hardness. There also exists a need in the art to provide a ball having two layers with the same hardness, but the two layers are different from each other with respect to specific processing or performance characteristics.

SUMMARY OF THE INVENTION

The present invention is directed to a golf ball including a core, a cover disposed about the core, wherein the cover includes an inner cover layer formed from a first composition having a first hardness and a first coefficient of friction and an outer cover layer formed from a second composition having a second hardness and a second coefficient of friction, wherein the second hardness differs from the first hardness by about 5 points or less, and wherein the second coefficient of friction is greater than the first coefficient of friction.

In one embodiment, the first coefficient of friction differs from the second coefficient of friction by about 0.1 or greater. In another embodiment, the first coefficient of friction differs from the second coefficient of friction by about 0.15 or greater. In yet another embodiment, the first coefficient of friction differs from the second coefficient of friction by about 0.2 or greater.

The first composition may be substantially similar to or different from the second composition. In one embodiment, the first composition includes a metallocene-catalyzed polymer, a partially neutralized ionomer, a fully neutralized ionomer, or thermoplastic polyester and the second composition comprises a polyurethane, polyurea, silicone, or epoxy. In another embodiment, the second composition includes a filler selected from the group consisting of precipitated hydrated silica, clay, talc, asbestos, glass fibers, aramid fibers, mica, calcium metasilicate, barium sulfate, zinc sulfide, lithopone, silicates, silicon carbide, diatomaceous earth, polyvinyl chloride, carbonates, metals, metal alloys, metal oxides, particulate carbonaceous materials, micro balloons, fly ash, and combinations thereof.

In one embodiment, the hardness of the second composition differs from the hardness of the first composition by about 3 points or less. In another embodiment, the first and second hardnesses are from about 25 to about 75 Shore D.

The golf ball of the invention may also include a wound layer having at least one tensioned material disposed between the core and the cover.

The present invention is also direct to a golf ball including a core, a cover disposed about the core, wherein the cover includes an inner cover layer formed from a first composition having a first hardness and a first thickness of about 0.01 to about 0.25 inches and an outer cover layer formed from a second composition having a second hardness and a second thickness, wherein the second hardness differs from the first hardness by about 5 points or less, and wherein the second thickness is less than the first thickness and from about 0.005 inches to about 0.1 inches.

In one embodiment, the first thickness is about 0.02 inches to about 0.05 inches and the second thickness is about 0.005 inches to about 0.035 inches.

The first and second compositions may be substantially similar or different from each other. In one embodiment, the first composition includes a metallocene-catalyzed polymer, a partially neutralized ionomer, a fully neutralized ionomer, or thermoplastic polyester and the second composition comprises a polyurethane, polyurea, silicone, or epoxy.

In another embodiment, the second composition is reaction injection moldable.

In yet another embodiment, the second hardness differs from the first hardness by about 3 points or less.

The present invention is further directed to a golf ball including a core, a cover disposed about the core, wherein the cover includes an inner cover layer formed from a first composition having a first hardness and a first flexural modulus and an outer cover layer formed from a second composition having a second hardness and a second flexural modulus, wherein the second hardness differs from the first hardness by about 5 points or less.

In this aspect of the invention, the first and second flexural moduli may be substantially similar at ambient temperature, wherein the second flexural modulus differs from the first flexural modulus at temperatures above or below ambient. In one embodiment, the first and second flexural moduli are from about 2,000 psi to about 100,000 psi. In another embodiment, the first and second flexural moduli are from about 5,000 psi to about 80,000 psi. In yet another embodiment, the first and second flexural moduli differ from each other by about 500 psi or greater. In still another embodiment, the first and second moduli differ from each other by about 5,000 psi or less.

The present invention is also directed to a golf ball having a core and a cover disposed about the core, wherein the cover includes an inner cover layer formed from a first composition having a first hardness and a first contact angle and an outer cover layer formed from a second composition having a second hardness and a second contact angle, wherein the second hardness differs from the first hardness by about 5 points or less.

The first and second contact angle may differ from each other by about 1° or greater. In one embodiment, the first and second contact angle differ from each other by about 3° or greater. In another embodiment, the first and second contact angle differ from each other by about 5° or greater.

BRIEF DESCRIPTION OF THE DRAWINGS

Further features and advantages of the invention can be ascertained from the following detailed description that is provided in connection with the drawing described below.

DETAILED DESCRIPTION OF THE INVENTION

Figure 1:
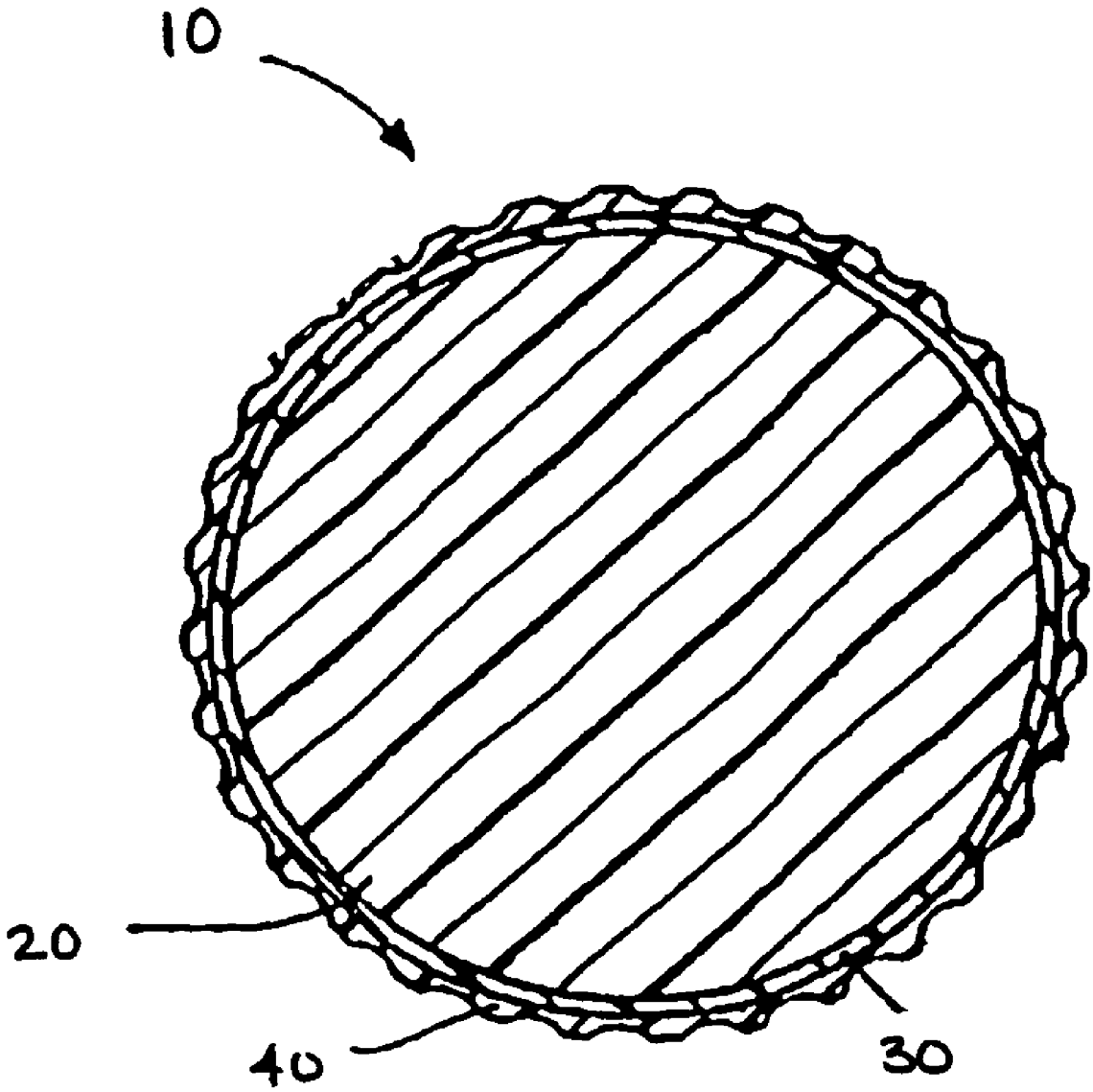
FIG. 1 is cross-sectional view of a multilayer golf ball according to the present invention.

The present invention is directed to a multilayer golf ball with high resilience, such as for low swing speed players, to provide greater distance off the tee while conforming to the USGA golf rules. In particular, the invention relates to a multilayer golf ball with multiple cover layers having essentially the same hardness to combine distance with feel. The invention further relates to a golf ball having a core and two or more cover layers, wherein the multiple cover layers are formed from materials that are substantially the same composition with the same Shore hardness, but are modified in some way to alter the processing or performance characteristics of the golf ball.

As used herein, the term "multilayer" means at least two layers and includes fluid or liquid center balls, wound balls, hollow-center balls, and balls with at least two intermediate layers and/or cover layers. As used herein, "hardness" refers to the hardness of the material forming the particular layer of the ball being discussed, as measured by ASTM D2240-00.Hardness does not refer to the hardness of the golf ball.

"Essentially the same hardness" refers to a difference in hardness between layers of a golf ball of no more than about 10 points, and more preferably no more than about 5 points, Shore C or Shore D, and even more preferably no more than about 3 points Shore C or Shore D. While the examples herein are directed to golf ball cover layers having essentially the same hardness, one of ordinary skill in the art would recognize that the present invention can also be used with golf ball cover layers having even greater differences in hardness. Thus, the invention as described herein is not limited only to golf ball cover layers having essentially the same hardness. For instance, the present invention could be used in combination with the teachings of U.S. Pat. Nos. 6,210,293, 5,688,191, 4,919,434, or 4,431,193.

The term "about," as used herein in connection with one or more numbers or numerical ranges, should be understood to refer to all such numbers, including all numbers in a range. A heavily filled or reinforced material can measure a higher hardness reading than the same unfilled material. It should be understood that, at least for purposes of this invention, the hardnesses of filled or reinforced materials will be deemed to have the hardness of the unfilled or unreinforced material.

As used herein the term "resilience index" is defined as the difference in loss tangent (tan δ) measured at 10 cpm and 1000 cpm divided by 990 (the frequency span) multiplied by 100,000 (for normalization and unit convenience). The loss tangent is measured using an RPA 2000 manufactured by Alpha Technologies of Akron, Ohio. The RPA 2000 is set to sweep from 2.5 to 1000 cpm at a temperature of 100° C. using an arc of 0.5 degrees. An average of six loss tangent measurements were acquired at each frequency and the average is used in calculation of the resilience index. The computation of resilience index is as follows:

$$\text{Resilience Index}=100{,}000\cdot[(\text{loss tangent@ 10 cpm})-(\text{loss tangent@ 1000 cpm})]/990$$

In particular, the invention relates to a multilayer golf ball with multiple cover layers having essentially the same hardness to combine the benefits of a harder, stiffer, more resilient ball (distance) with a softer, more responsive ball (good spin, feel, and sound). While the layers have similar hardnesses, the materials used to form the layers may have different inherent properties that effect the overall properties of the golf ball. The multiple cover layers used with a golf ball of the present invention can be formed from the same or different compositions.

When the same compositions are used in both an inner and an outer cover layer, additives can be used to alter the properties, such as colors, coefficient of friction, specific gravity, dynamic modulus, or other dynamic mechanical properties, resiliences, wettabilities, melting or softening points, melt flow properties, abrasion resistences, natural frequencies, tear resistances, tensile yield strengths, or combinations thereof that can advantageously improve processing or performance characteristics, while still maintaining the same hardness for each material layer composition. The cover layers of the golf ball are preferably not formed of foamed materials. It should be understood that, with respect to this embodiment, any suitable center, core, winding, or intermediate layer constructions can be used, although some examples are provided below.

The present invention is directed to a golf ball 10 with multiple cover layers having essentially the same hardness as shown in FIG. 1, but at least one of the layers has been modified in some way to alter a property that affects the performance of the ball. In one embodiment, both covers layers can be formed of the same material and have essentially the same hardness, but the layers are designed to have different coefficient of friction values.

As is known by those of ordinary skill in the art, the coefficient of friction of a golf ball, and the layers therein, in particular, has a direct effect on the amount of spin imparted to a golf ball when hit by a golf club. For example, layers with low coefficient of friction values will result in less resistance, or higher slippage, between the two layers, as well as between the outer cover layer and the club face. An inner cover layer having a low coefficient of friction may allow the outer cover to momentarily slip about the inner cover layer core so that the spin normally imparted to the ball by striking with a club is substantially reduced. In other words, the outer cover can spin, but such spin is not fully transferred to the inner components of the ball. On the other hand, layers with high coefficient of friction values will have more resistance between the layers, and, thus, less slippage between the two layers. Therefore, the spin of the outer cover will likely control the spin of the rest of ball.

The coefficient of friction is a function of pressure or perpendicular force, as well as surface roughness and degree of lubricity. Thus, the coefficient of friction may be adjusted for certain materials by altering the surface or pressure applied to the golf ball. For example, lubricants may be added to a composition containing materials having relatively high coefficient of friction values to reduce the coefficient of friction. Non-limiting examples of lubricants include silicone, graphite, and molybdenum disulfide. In addition, lubricating films disposed between the core and the cover or on the surface of the outer cover, as disclosed in U.S. Pat. Nos. 5,827,133 and 6,217,464, respectively, may reduce the coefficient of friction between the core and the outer cover or the outer cover and the club, respectively.

Examples of polymers with low coefficient of friction values, generally about 0.1 or less, include, but are not limited to, fluoropolymers, polyamides, and high modulus ionomers having flexural moduli of greater than about 50,000 psi. Polymers with relatively high coefficient of friction values, generally about 0.4 or greater, include thermoplastic elastomers and polyurethanes. Low modulus ionomers, those ionomers having a flexural modulus of less than about 30,000 psi, may also have high coefficient of friction values.

The coefficient of friction of polymers may be measured by any method known to those of ordinary skill in the art. One example of a suitable method to measure static and dynamic friction using ASTM D3702, i.e., the thrust washer test, wherein a polymeric sample is mated against a steel thrust washer and the test apparatus is rotated and the torque required in measured. The measurements taken are an average of the friction coefficients measured every 24 hours during a testing period of about 168 hours to about 200 hours. This test may be used in applications that involve repetitive motion over the same surfaces. ASTM D1984 may be used to measure friction coefficients when contact between two surfaces is brief. This test is also known as the friction rig or sliding sled test because the force required to pull a rig or sled over a flat surface is measured using about 5 to about 10 pulls over the same surface. In addition, U.S. Pat. No. 6,016,685 provides a relatively simple apparatus for determining the coefficient of static friction of a golf ball, which may be useful with the present invention.

Therefore, golf ball performance may be affected through adjusting the coefficient of friction values of the layers of a golf ball. Thus, in one embodiment, the difference between the coefficient of friction values between the cover layers is about 0.1 or greater. In another embodiment, the difference is about 0.15 or greater. In yet another embodiment, the difference is about 0.2 or greater.

Fillers may be used to adjust the coefficient of friction of the cover layers. By adjusting the coefficient of friction of the cover layers, some movement or slippage is allowed between the layers, or between the outer cover layer and the club face. In addition, fillers may be added to at least one cover layer to increase the moment of inertia and reduce initial spin rates.

As used herein, the term "fillers" includes any compound or composition that can be used to adjust the density and/or other properties of a golf ball layer. Fillers useful according to the present invention include, for example, zinc oxide, barium sulfate, flakes, fibers, and regrind or finely divided rubber, which is ground, recycled core material (for example, ground to about 30 mesh particle size).

Fillers are typically polymeric or mineral particles. Exemplary fillers include precipitated hydrated silica; clay; talc; asbestos; glass fibers; aramid fibers; mica; calcium metasilicate; barium sulfate; zinc sulfide; lithopone; silicates; silicon carbide; diatomaceous earth; polyvinyl chloride; carbonates such as calcium carbonate and magnesium carbonate; metals such as titanium, tungsten, aluminum, bismuth, nickel, molybdenum, iron, lead, copper, boron, cobalt, beryllium, zinc, and tin; metal alloys such as steel, brass, bronze, boron carbide whiskers, and tungsten carbide whiskers; metal oxides such as zinc oxide, iron oxide, aluminum oxide, titanium oxide, magnesium oxide, and zirconium oxide; particulate carbonaceous materials such as graphite, carbon black, cotton flock, natural bitumen, cellulose flock, and leather fiber; micro balloons such as glass and ceramic; fly ash; and combinations thereof.

For example, a finely divided rubber, when used in an ionomer composition, will preferentially migrate to the surface of the ionomer and alter the coefficient of friction for that layer. Very hard, very fine particulate fillers, flakes, or fibers, such as carbon black, effect the surface properties of the layer without substantially affecting the bulk properties, i.e., the hardness.

Another embodiment of the present invention relates to a golf ball with multiple cover layers having essentially the same hardness, but different rheological properties under high deformation. For example, an outer cover layer 40 can be designed to be more responsive than an inner cover layer 30 when struck with a club to simulate a soft outer cover over hard inner cover ball.

Varying the thicknesses of the layer has also been found to be beneficial in altering the effective modulus of each layer and simulating a soft outer cover over a hard inner cover. For example, a thin polyurethane outer cover layer over a thick layer of ionomer will behave similarly to a soft outer cover over hard inner cover ball. Thus, another aspect of the present invention relates to a golf ball with multiple cover layers having essentially the same hardness, but different thicknesses to simulate a soft outer cover over hard inner cover ball.

The outer cover layer 40 in the third embodiment preferably has a thickness of about 0.005 inches or greater. In one embodiment, the outer cover layer 40 thickness is about 0.01 inches or greater. In another embodiment, the outer cover layer 40 thickness is about 0.030 inches or greater. In yet another embodiment, the outer cover layer 40 thickness is about 0.1 inches or less. In still another embodiment, the outer cover layer 40 thickness is about 0.035 inches or less.

The inner cover layer 30 preferably has a thickness of about 0.01 inches or greater. In one embodiment, the inner cover layer 30 has a thickness of about 0.02 inches or greater. In another embodiment, the inner cover layer 30 has a thickness of about 0.25 inches or less. In yet another embodiment, the inner cover layer has a thickness of about 0.05 inches or less. In one embodiment, the outer cover layer has a thickness of about 0.005 inches to about 0.035 inches and the inner cover layer has a thickness of about 0.02 inches to about 0.05 inches.

Another aspect of the present invention relates to a golf ball 10 with multiple cover layers having essentially the same hardness, but differences in flexural moduli. The flexural moduli of the cover layers are about 500 psi or greater, preferably about 2,000 psi or greater, and more preferably about 5,000 psi or greater. In another embodiment, the flexural moduli of the cover layers are about 150,000 psi or less, preferably about 100,000 psi or less, and more preferably about 80,000 or less.

Fillers, e.g., zinc oxide, barium sulfate, flakes, fibers, and regrind, may be used to modulate the flexural moduli of any given cover layer, while having little to no effect on the hardness of the layer. The addition of filler into a composition of the invention may result in nominal hardness changes, but large flexural moduli changes depending on the degree of reinforcement, thus allowing for an outer cover with a high flexural modulus and an inner cover with a lower flexural modulus, or an inner cover with a high flexural modulus and an outer cover with a lower flexural modulus. For example, the hardness of a carbon fiber reinforced polyurethane may differ from an unreinforced polyurethane by about 5 points or less, while the flexural modulus may vary from about 5,000 psi to about 100,000 psi depending on the degree of reinforcement.

In this aspect of the invention, the difference between the flexural moduli of the two cover layers is preferably about 5,000 psi or less. In another embodiment, the difference in flexural moduli is about 500 psi or greater. In one embodiment, the difference in flexural moduli between the two cover layers formed of unreinforced or unmodified materials is about 1,000 psi to about 2,500 psi. In another embodiment, the difference in the flexural moduli between the two cover layers, wherein at least one is reinforced is about 500 psi to about 100,000 psi, preferably from about 500 psi to about 5,000 psi.

In another aspect of the invention, the cover layers of a golf ball have essentially the same hardness, but different properties at high or low temperatures as compared to ambient temperatures. In particular, this aspect of the invention is directed to a golf ball having multiple cover layers wherein the outer cover layer composition has a lower flexural modulus at reduced temperatures than the inner cover layer, while the layers retain the same hardness at ambient and reduced temperatures, which results in a simulated soft outer cover layer over a hard inner cover layer feel. Certain polyurethanes have a much more stable flexural modulus at different temperatures than ionomer resins and thus, could be used to make an effectively "softer" layer at lower temperatures than at ambient or elevated temperatures.

In one embodiment, the difference between the flexural moduli of the two cover layers at ambient temperatures is about 500 psi or less. The difference between flexural moduli of the two cover layers at temperatures below ambient is about 5,000 psi or less, preferably about 2,500 or less, and more preferably about 1,000 psi or less.

Yet another aspect of the present invention relates to a golf ball 10 with multiple cover layers having essentially the same hardness, but different properties under wet conditions as compared to dry conditions. For example, an outer cover layer 40 with a lower wettability may make a golf ball less slippery in rainy conditions, and allow a player to be more consistent in the rain, snow, or other such challenging playing conditions where the player requires additional performance from the ball.

Wettability of a golf ball layer may be affected by surface roughness, chemical heterogeneity, molecular orientation, swelling, and interfacial tensions, among others. Thus, non-destructive surface treatments of a golf ball layer may aid in increasing the hydrophilicity of a layer, while highly polishing or smoothing the surface of a golf ball layer may decrease wettability. U.S. Pat. Nos. 5,403,453 and 5,456,972 disclose methods of surface treating polymer materials to affect the wettability, the entire disclosures of which are incorporated by reference herein. In addition, plasma etching, corona treating, and flame treating may be useful surface treatments to alter the wettability to desired conditions. Wetting agents may also be added to the golf ball layer composition to modify the surface tension of the layer. For example. fillers that can be added to the compositions to alter the wettability properties for the selected layer include silicone or fluorine compounds, as well as nano particles, flaked-metals, such as mica, iron oxide, and aluminum, or ceramic particles disposed in the film to resist the transmission of moisture into the inner components of the ball. In one embodiment, the silicone or fluorine compound is added to the composition used to form the outer cover layer of the ball. The addition of these compounds and their affect on the wettability of a layer can result in a slower spinning golf ball.

Wettability of materials may be measured through a variety of techniques known to those of ordinary skill in the art. For example, contact angle measurements of a polymer substrates are good indicators of wetting and adhesion properties. A low contact angle measurement generally indicates a high wettability because as the droplet hits the substrate, it extends along the hydrophilic surface, whereas a high contact angle is reflective of a lower wettability because the droplet profile remains intact after contacting the hydrophobic surface. A non-limiting example of an instrument useful in measuring contact angle is the CAM 200 manufactured by KSV Instruments of Helsinki, Finland, which may measure both advancing and receding contact angles of a liquid droplet on a polymer sample substrate.

Thus, the differences in wettability of the cover layers according to the invention may be measured by a difference in contact angle. The contact angles for a layer may be from about 1° (low wettability) to about 180° (very high wettability). In one embodiment, the cover layers have contact angles that vary by about 1° or greater. In another embodiment, the contact angles of the cover layer vary by about 3° or greater. In yet another embodiment, the contact angles of the cover layers vary by about 5° or greater.

The golf ball 10 may also be constructed with a hydrophobic inner layer 30, or a moisture barrier layer 30, and a hydrophilic outer layer 40. A moisture vapor barrier layer is preferably designed to have a lower moisture vapor transmission rate than that of the outer cover of the ball. As used herein, the term "moisture vapor transmission rate" is defined as the mass of moisture vapor that diffuses into a material of a given thickness per unit area per time. The preferred standards for measuring the moisture vapor transmission rate include ASTM F1249-90 and ASTM F372-99. In one embodiment, the moisture vapor transmission rate of the moisture vapor barrier layer is about 1 gram-mm/$m^2$-day or less. In another embodiment, the moisture vapor transmission rate of the moisture vapor barrier layer is about 0.45 grams-mm/$m^2$-day or less. In yet another embodiment, the moisture vapor transmission rate of the moisture vapor barrier layer is about 0.3 grams-mm/$m^2$-day or less. The moisture vapor barrier layer can be formed from multi-layer thermoplastic films, blend of ionomers, polyvinyl alcohol copolymers and polyamides, dispersions of acid salts of polyetheramines. In one embodiment, the moisture vapor barrier layer has a high specific gravity to contribute to a high moment of inertia, low spin ball.

Covers

Properties that are desirable for the cover layers are good moldability, high abrasion resistance, high tear strength, high resilience, and good mold release, among others. The cover typically has a thickness to provide sufficient strength, good performance characteristics and durability. The cover layers, inner and outer cover layers, can each include any materials known to those of ordinary skill in the art, including thermoplastic and thermosetting materials. This golf ball can likewise include one or more homopolymeric or copolymeric materials, such as:

(1) Vinyl resins, such as those formed by the polymerization of vinyl chloride, or by the copolymerization of vinyl chloride with vinyl acetate, acrylic esters or vinylidene chloride;

(2) Polyolefins, such as polyethylene, polypropylene, polybutylene and copolymers such as ethylene methylacrylate, ethylene ethylacrylate, ethylene vinyl acetate, ethylene methacrylic or ethylene acrylic acid or propylene acrylic acid and copolymers and homopolymers produced using a single-site catalyst or a metallocene catalyst;

(3) Polyurethanes, such as those prepared from polyols and diisocyanates or polyisocyanates and those disclosed in U.S. Pat. No. 5,334,673;

(4) Polyureas, such as those disclosed in U.S. Pat. No. 5,484,870;

(5) Polyamides, such as poly(hexamethylene adipamide) and others prepared from diamines and dibasic acids, as well as those from amino acids such as poly(caprolactam), and blends of polyamides with SURLYN, polyethylene, ethylene copolymers, ethyl-propylene-non-conjugated diene terpolymer, and the like;

(6) Acrylic resins and blends of these resins with poly vinyl chloride, elastomers, and the like;

(7) Thermoplastics, such as urethanes; olefinic thermoplastic rubbers, such as blends of polyolefins with ethylene-propylene-non-conjugated diene terpolymer; block copolymers of styrene and butadiene, isoprene or ethylene-butylene rubber; or copoly(ether-amide), such as PEBAX, sold by Atofina of Philadelphia, Pa. (formerly Elf Atochem);

(8) Polyphenylene oxide resins or blends of polyphenylene oxide with high impact polystyrene as sold under the trademark NORYL by General Electric Company of Pittsfield, Mass.;

(9) Thermoplastic polyesters, such as polyethylene terephthalate, polybutylene terephthalate, polyethylene terephthalate/glycol modified and elastomers sold under the trademarks HYTREL by E.I. DuPont de Nemours & Co. of Wilmington, Del., and LOMOD by General Electric Company of Pittsfield, Mass.;

(10) Blends and alloys, including polycarbonate with acrylonitrile butadiene styrene, polybutylene terephthalate, polyethylene terephthalate, styrene maleic anhydride, polyethylene, elastomers, and the like, and polyvinyl chloride with acrylonitrile butadiene styrene or ethylene vinyl acetate or other elastomers; and

(11) Blends of thermoplastic rubbers with polyethylene, propylene, polyacetal, nylon, polyesters, cellulose esters, and the like.

In one embodiment, the cover layer(s) include one or more polymers, such as ethylene, propylene, butene-1 or hexane-1 based homopolymers or copolymers including functional monomers, such as acrylic and methacrylic acid and fully or partially neutralized ionomer resins and their blends, methyl acrylate, methyl methacrylate homopolymers and copolymers, imidized, amino group containing polymers, polycarbonate, reinforced polyamides, polyphenylene oxide, high impact polystyrene, polyether ketone, polysulfone, poly(phenylene sulfide), acrylonitrile-butadiene, acrylic-styrene-acrylonitrile, poly(ethylene terephthalate), poly(butylene terephthalate), poly(ethelyne vinyl alcohol), poly(tetrafluoroethylene) and their copolymers including functional comonomers, and blends thereof. Suitable cover compositions also include a polyether or polyester thermoplastic urethane, a thermoset polyurethane, a low modulus ionomer, such as acid-containing ethylene copolymer ionomers, including E/X/Y terpolymers where E is ethylene, X is an acrylate or methacrylate-based softening comonomer present in about 0 to 50 weight percent and Y is acrylic or methacrylic acid present in about 5 to 35 weight percent. More preferably, in a low spin rate embodiment designed for maximum distance, the acrylic or methacrylic acid is present in about 15 to 35 weight percent, making the ionomer a high modulus ionomer. In a high spin embodiment, the cover includes an ionomer where an acid is present in about 10 to 15 weight percent and includes a softening comonomer. In one preferred embodiment of the invention, one or more polyurea components can be included in the inner cover layer, the outer cover layer, or both.

Each cover layer can have a thickness of at least about 0.005 inches to distinguish the layers from a coating, and preferably the thickness of each layer is at least about 0.01 inches. The total thickness of the cover layers can be up to about 0.2 inches, preferably less than about 0.125 inches. The hardness of the cover layer material can be about 10 Shore D or greater, preferably about 20 Shore D or greater, and more preferably about 25 Shore D or greater. In one embodiment, the cover hardness is about 80 Shore D or less, preferably about 75 Shore D or less. The ball compression can be less than about 100, preferably less than about 90.

Outer Cover Layer

The outer cover of the golf ball can include materials such as polyurethane, thermoplastic copoly(amide-ethers), silicone, epoxy, and polyurea. Suitable commercially available thermoplastic copoly(amide-ethers) include the PEBAX® series from Elf-Atochem, which includes PEBAX® 2533, 3533, 4033 and 6333; the GRILAMID® series by Emser, which includes Ely 60; and VESTAMID® and VESTENAMER® by Hüls. In one embodiment, the materials are reaction injection moldable.

The outer cover of the present invention preferably includes a polyurethane composition comprising the reaction product of at least one polyisocyanate and at least one curing agent. The curing agent can include, for example, one or more diamines, one or more polyols, or a combination thereof. The at least one polyisocyanate can be combined with one or more polyols to form a prepolymer, which is then combined with the at least one curing agent. Thus, when polyols are described herein they can be suitable for use in one or both components of the polyurethane material, i.e., as part of a prepolymer and in the curing agent. The polyurethane composition can be used in forming the outer cover layer, the inner cover layer, or both. In one preferred embodiment, the outer cover includes the polyurethane composition.

In a different preferred embodiment, the curing agent includes a polyol curing agent. In a more preferred embodiment, the polyol curing agent includes ethylene glycol; diethylene glycol; polyethylene glycol; propylene glycol; polypropylene glycol; lower molecular weight polytetramethylene ether glycol; 1,3-bis(2-hydroxyethoxy)benzene; 1,3-bis-[2-(2-hydroxyethoxy)ethoxy]benzene; 1,3-bis-{2-[2-(2-hydroxyethoxy)ethoxy]ethoxy}benzene; 1,4-butanediol; 1,5-pentanediol; 1,6-hexanediol; resorcinol-di-(β-hydroxyethyl) ether; hydroquinone-di-(β-hydroxyethyl)ether; trimethylol propane, or mixtures thereof. In one embodiment, the polyurethane composition includes at least one isocyanate and at least one curing agent. In yet another embodiment, the polyurethane composition includes at least one isocyanate, at least one polyol, and at least one curing agent. In a preferred embodiment, the isocyanate includes 4,4'-diphenylmethane diisocyanate, polymeric 4,4'-diphenylmethane diisocyanate, carbodiimide-modified liquid 4,4'-diphenylmethane diisocyanate, 4,4'-dicyclohexylmethane diisocyanate, p-phenylene diisocyanate, toluene diisocyanate, isophoronediisocyanate, p-methylxylene diisocyanate, m-methylxylene diisocyanate, o-methylxylene diisocyanate, or a mixture thereof. In another preferred embodiment, the at least one polyol includes a polyether polyol, hydroxy-terminated polybutadiene, polyester polyol, polycaprolactone polyol, polycarbonate polyol, or mixtures thereof. In yet another preferred embodiment, the curing agent includes a polyamine curing agent, a polyol curing agent, or a mixture thereof. In a more preferred embodiment, the curing agent includes a polyamine curing agent. In a most preferred embodiment, the polyamine curing agent includes 3,5-dimethylthio-2,4-toluenediamine, or an isomer thereof; 3,5-diethyltoluene-2,4-diamine, or an isomer thereof; 4,4'-bis-(sec-butylamino)-diphenylmethane; 1,4-bis-(sec-butylamino)-benzene, 4,4'-methylene-bis-(2-chloroaniline); 4,4'-methylene-bis-(3-chloro-2,6-diethylaniline); trimethylene glycol-di-p-aminobenzoate; polytetramethyleneoxide-di-p-aminobenzoate; N,N'-dialkyldiamino diphenyl methane; p, p'-methylene dianiline; phenylenediamine; 4,4'-methylene-bis-(2-chloroaniline); 4,4'-methylene-bis-(2,6-diethylaniline); 4,4'-diamino-3,3'-diethyl-5,5'-dimethyl diphenylmethane; 2,2', 3,3'-tetrachloro diamino diphenylmethane; 4,4'-methylene-bis-(3-chloro-2,6-diethylaniline); or mixtures thereof.

Any polyisocyanate available to one of ordinary skill in the art is suitable for use according to the invention. Exemplary polyisocyanates include, but are not limited to, 4,4'-diphenylmethane diisocyanate ("MDI"), polymeric MDI, carbodiimide-modified liquid MDI, 4,4'-dicyclohexylmethane diisocyanate ("$H_{12}$MDI"),p-phenylene diisocyanate ("PPDI"), toluene diisocyanate ("TDI"), 3,3'-dimethyl-4,4'-biphenylene diisocyanate ("TODI"), isophoronediisocyanate ("IPDI"), hexamethylene diisocyanate ("HDI"), naphthalene diisocyanate ("NDI"); xylene diisocyanate ("XDI"); para-tetramethylxylene diisocyanate ("p-TMXDI"); meta-tetramethylxylene diisocyanate ("m-TMXDI"); ethylene diisocyanate; propylene-1,2-diisocyanate; tetramethylene-1,4-diisocyanate; cyclohexyl diisocyanate; 1,6-hexamethylene-diisocyanate ("HDI"); dodecane-1,12-diisocyanate; cyclobutane-1,3-diisocyanate; cyclohexane-1,3-diisocyanate; cyclohexane-1,4-diisocyanate; 1-isocyanato-3,3,5-trimethyl-5-isocyanatomethylcyclohexane; methyl cyclohexylene diisocyanate; triisocyanate of HDI; triisocyanate of 2,4,4-trimethyl-1,6-hexane diisocyanate ("TMDI"), tetracene diisocyanate, naphthalene diisocyanate, anthracene diisocyanate, and mixtures thereof. Polyisocyanates are known to those of ordinary skill in the art as having more than one isocyanate group, e.g., di-, tri-, and tetra-isocyanate. Preferably, the polyisocyanate includes MDI, PPDI, TDI, or a mixture thereof, and more preferably, the polyisocyanate includes MDI. It should be understood that, as used herein, the term "MDI" includes 4,4'-diphenylmethane diisocyanate, polymeric MDI, carbodiimide-modified liquid MDI, and mixtures thereof and, additionally, that the diisocyanate employed can be "low free monomer," understood by one of ordinary skill in the art to have lower levels of "free" monomer isocyanate groups than conventional diisocyanates, i.e., the compositions of the invention typically have less than about 0.1% free monomer groups. Examples of "low free monomer" diisocyanates include, but are not limited to Low Free Monomer MDI, Low Free Monomer TDI, and Low Free Monomer PPDI.

The at least one polyisocyanate should have less than about 14 percent unreacted NCO groups. Preferably, the at least one polyisocyanate has no greater than about 7.5 percent NCO, more preferably, from about 2.5 percent to about 7.5 percent, and most preferably, from about 4 percent to about 6.5 percent.

Any polyol available to one of ordinary skill in the art is suitable for use according to the invention. Exemplary polyols include, but are not limited to, polyether polyols, hydroxy-terminated polybutadiene (including partially/fully hydrogenated derivatives), polyester polyols, polycaprolactone polyols, and polycarbonate polyols. In one preferred embodiment, the polyol includes polyether polyol, more preferably those polyols that have the generic structure:

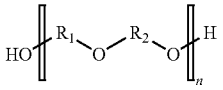

where $R_1$ and $R_2$ are straight or branched hydrocarbon chains, each containing from 1 to about 20 carbon atoms, and n is a whole integer that ranges from 1 to about 45. Examples include, but are not limited to, polytetramethylene ether glycol ("PTMEG"), polyethylene propylene glycol, polyoxypropylene glycol, and mixtures thereof. The hydrocarbon chain can have saturated or unsaturated bonds and substituted or unsubstituted aromatic and cyclic groups. Preferably, the polyol of the present invention includes PTMEG.

In another embodiment, polyester polyols are included in the polyurethane material of the invention. Preferred polyester polyols have the generic structure:

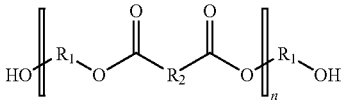

where $R_1$ and $R_2$ are straight or branched hydrocarbon chains, each containing from 1 to about 20 carbon atoms, and n is a whole integer that ranges from 1 to about 25. Suitable polyester polyols include, but are not limited to, polyethylene adipate glycol, polybutylene adipate glycol, polyethylene propylene adipate glycol, ortho-phthalate-1,6-hexanediol, and mixtures thereof. The hydrocarbon chain can have saturated or unsaturated bonds, or substituted or unsubstituted aromatic and cyclic groups.

In another embodiment, polycaprolactone polyols are included in the materials of the invention. Preferably, any polycaprolactone polyols have the generic structure:

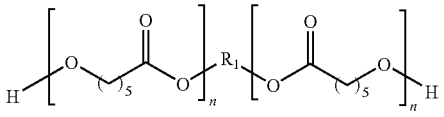

where $R_1$ is a straight chain or branched hydrocarbon chain containing from 1 to about 20 carbon atoms, and n is the chain length and is a whole integer that ranges from 1 to about 20. Suitable polycaprolactone polyols include, but are not limited to, 1,6-hexanediol-initiated polycaprolactone, diethylene glycol initiated polycaprolactone, trimethylol propane initiated polycaprolactone, neopentyl glycol initiated polycaprolactone, 1,4-butanediol-initiated polycaprolactone, and mixtures thereof. The hydrocarbon chain can have saturated or unsaturated bonds, or substituted or unsubstituted aromatic and cyclic groups.

In yet another embodiment, the polycarbonate polyols are included in the polyurethane material of the invention. Preferably, any polycarbonate polyols have the generic structure:

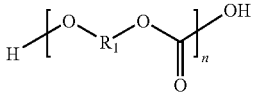

where $R_1$ is predominantly bisphenol A units -(p-$C_6H_4$)—C$(CH_3)_2$-(p-$C_6H_4$)— or derivatives thereof, and n is the chain length and is an integer that ranges from 1 to about 20. Suitable polycarbonates include, but are not limited to, polyphthalate carbonate. The hydrocarbon chain can have saturated or unsaturated bonds, or substituted or unsubstituted aromatic and cyclic groups. In one embodiment, the molecular weight of the polyol is from about 200 to about 4000.

Polyamine curatives are also suitable for use in the curing agent of the polyurethane composition of the invention and have been found to improve cut, shear, and impact resistance of the resultant balls. Preferred polyamine curatives include, but are not limited to, 3,5-dimethylthio-2,4-toluenediamine and isomers thereof; 3,5-diethyltoluene-2,4-diamine and isomers thereof, such as 3,5-diethyltoluene-2,6-diamine; 4,4'-bis-(sec-butylamino)-diphenylmethane; 1,4-bis-(sec-butylamino)-benzene, 4,4'-methylene-bis-(2-chloroaniline); 4,4'-methylene-bis-(3-chloro-2,6-diethylaniline); polytetramethyleneoxide-di-p-aminobenzoate; N,N'-dialkyldiamino diphenyl methane; p,p'-methylene dianiline ("MDA"); m-phenylenediamine ("MPDA"); 4,4'-methylene-bis-(2-chloroaniline) ("MOCA"); 4,4'-methylene-bis-(2,6-diethylaniline); 4,4'-diamino-3,3'-diethyl-5,5'-dimethyl diphenylmethane; 2,2', 3,3'-tetrachloro diamino diphenylmethane; 4,4'-methylene-bis-(3-chloro-2,6-diethylaniline); trimethylene glycol di-p-aminobenzoate; and mixtures thereof. Preferably, the curing agent of the present invention includes 3,5-dimethylthio-2,4-toluenediamine and isomers thereof, such as ETHACURE 300. Suitable polyamine curatives, which include both primary and secondary amines, preferably have weight average molecular weights ranging from about 64 to about 2000.

Other suitable polyamine curatives include those having the general formula:

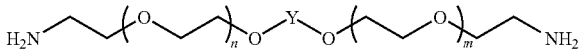

where n and m each separately have values of 0, 1, 2, or 3, and where Y is 1,2-cyclohexyl, 1,3-cyclohexyl, 1,4-cyclohexyl, ortho-phenylene, meta-phenylene, orpara-phenylene, or a combination thereof. Preferably, n and m, each separately, have values of 0, 1, or 2, and preferably, 1 or 2.

At least one of a diol, triol, tetraol, or hydroxy-terminated curative can be added to the aforementioned polyurethane composition. Suitable diol, triol, and tetraol groups include ethylene glycol; diethylene glycol; polyethylene glycol; propylene glycol; polypropylene glycol; lower molecular weight polytetramethylene ether glycol; 1,3-bis(2-hydroxyethoxy) benzene; 1,3-bis-[2-(2-hydroxyethoxy)ethoxy]benzene; 1,3-bis-{2-[2-(2-hydroxyethoxy) ethoxy]ethoxy}benzene; 1,4-butanediol; 1,5-pentanediol; 1,6-hexanediol; resorcinol-di-(β-hydroxyethyl)ether; hydroquinone-di-(β-hydroxyethyl) ether; and mixtures thereof. Preferred hydroxy-terminated curatives include ethylene glycol; diethylene glycol; 1,4-butanediol; 1,5-pentanediol; 1,6-hexanediol, trimethylol propane, and mixtures thereof.

Preferably, the hydroxy-terminated curatives have molecular weights ranging from about 48 to 2000. It should be understood that molecular weight, as used herein, is the absolute weight average molecular weight and would be understood as such by one of ordinary skill in the art. Other suitable hydroxy-terminated curatives have the following general chemical structure:

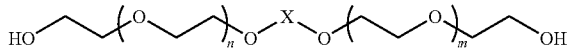

where n and m each separately have values of 0, 1, 2, or 3, and where X is ortho-phenylene, meta-phenylene, para-phenylene, 1,2-cyclohexyl, 1,3-cyclohexyl, or 1,4-cyclohexyl, or mixtures thereof. Preferably, n and m each separately have values of 0, 1, or 2, and more preferably, 1 or 2.

Both the hydroxy-terminated and amine curatives can include one or more saturated, unsaturated, aromatic, and cyclic groups. Additionally, the hydroxy-terminated and amine curatives can include one or more halogen groups. The polyurethane composition can be formed with a blend or mixture of curing agents. If desired, however, the polyurethane composition can be formed with a single curing agent.

Any method known to one of ordinary skill in the art can be used to combine the polyisocyanate, polyol, and curing agent of the present invention. One commonly employed method, known in the art as a one-shot method, involves concurrent mixing of the polyisocyanate, polyol, and curing agent. This method results in a mixture that is inhomogenous (more random) and affords the manufacturer less control over the molecular structure of the resultant composition. A preferred method of mixing is known as a prepolymer method. In this method, the polyisocyanate and the polyol are mixed separately prior to addition of the curing agent. This method affords a more homogeneous mixture resulting in a more consistent polymer composition.

An optional filler component can be chosen to impart additional density to blends of the previously described components. The selection of the filler component is dependent upon the characteristics of the golf ball desired. Examples of fillers for use in the filler component of the polyurethane include those described herein for the polybutadiene reaction component. Similar or identical additives, such as nanoparticles, fibers, glass spheres, and/or various metals, such as titanium and tungsten, can be added to the polyurethane compositions of the present invention, as well, in amounts as needed to modify one or more golf ball properties. Additional components that can be added to the polyurethane composition include UV stabilizers and other dyes, as well as optical brighteners and fluorescent pigments and dyes. Such additional ingredients can be added in any amounts that will achieve their desired purpose.

Due to the very thin nature, it has been found by the present invention that the use of a castable, reactive material, which is applied in a fluid form, makes it possible to obtain very thin outer cover layers on golf balls. Specifically, it has been found that castable, reactive liquids, which react to form a urethane elastomer material, provide desirable very thin outer cover layers.

The outer cover layer preferably has a thickness of about 0.005 to about 0.2 inches, preferably from about 0.005 inches to about 0.1 inches. In one embodiment, the outer cover layer is less than about 0.1 inches, more preferably, less than about 0.05 inches, and most preferably, from about 0.02 to about 0.04 inches.

In particular, the material of the outer cover layer should have a material hardness, as measured by ASTM D2240-00, from about 10 to about 80 Shore D, preferably from about 30 to about 70 Shore D. In another embodiment, the hardness of the outer cover material is about 35 to about 65 Shore D. The hardness is measured in plaque form, i.e., a slab of the unfilled material, and will have a slightly lower hardness than if the material was measured as a filled or reinforced material. When the hardness of the outer cover material is measured by measuring the hardness of the golf ball, the hardness tends to be higher than for the material. For example, a hardness of 45 Shore D for the cover material might be 55 Shore D when measured on the ball.

The compression of the outer cover layer is typically from about 20 to 100, preferably from about 50 to 95. In one preferred embodiment, the outer cover layer compression is from about 75 to 90. As used herein, the term "Atti compression" and "compression" is defined as the deflection of an object or material relative to the deflection of a calibrated spring, as measured with an Atti Compression Gauge, that is commercially available from Atti Engineering Corp. of Union City, N.J. Atti compression is typically used to measure the compression of a golf ball. Compression values are dependent on the diameter of the article being measured.

In one embodiment, the specific gravity of the cover material is from about 1 or greater. In another embodiment, the specific gravity of the cover material is about 1.1 or greater. In yet another embodiment, the specific gravity is about 2 or less, preferably about 1.4 or less. In one preferred embodiment, the cover material has a specific gravity of about 1.15 to 1.25.

One measure of resilience is the "loss tangent," or tan δ, which is obtained when measuring the dynamic stiffness of an object. Loss tangent and terminology relating to such dynamic properties is typically described according to ASTM D4092-90. Thus, a lower loss tangent indicates a higher resiliency, thereby indicating a higher rebound capacity. Low loss tangent indicates that most of the energy imparted to a golf ball from the club is converted to dynamic energy, i.e., launch velocity and resulting longer distance. In one embodiment, the cover typically has a loss tangent of 0.16 to 0.075 from −30° C. to 20° C. In one embodiment, the complex modulus of the cover layer on the ball is from about 1000 to 2800 Kgf/cm$^2$ from −30° C. to 20° C.

The flexural modulus of the outer cover on the golf balls is typically greater than about 500 psi, and is preferably from about 500 psi to 150,000 psi. As used herein, "flexural modulus" is measured by ASTM D6272-98, Procedure B, as modified, about two weeks after polymer formation. As used herein, the term "stiffness" refers to the flexural modulus.

Inner Cover Layer

The inner cover layer 30 of the golf ball 10 can be formed with materials such as thermoplastic or thermoset materials, such as ionomer resins, polyurethanes, polyamides, polyesters, polyetheresters, polyetheramides, dynamically vulcanized elastomers, polyureas, styrene-butadiene rubbers, functionalized styrenebutadiene elastomers, metallocene-catalyzed polymers, nylons, acrylonitrile butadiene-styrene copolymers, cis- or trans-polyisoprene (balata) or blends thereof. Co-pending U.S. patent application Ser. No. 10/138,304, filed May 6, 2002, and entitled "Golf Ball Incorporating Grafted Metallocene-Catalyzed Polymer Blends" discloses polyamide compositions that may be mixed with ionomers or non-ionomers, including grafted or non-grafted metallocene catalyzed polymers, as well as grafted metallocene catalyzed polymer compositions that may be mixed with at least one of an ionomer, a non-grafted or unfunctionalized metallocene catalyzed polymer, polyamide, or other non-ionomeric polymer, that may be used in any layer of a golf ball, and are particularly useful in forming the inner cover layers of the present invention. The entire disclosure of U.S. patent application Ser. No. 10/138,304 is incorporated by reference herein.

Suitable commercially available ionomer resins include the SURLYN® series from DuPont. Suitable commercially available metallocene-catalyzed polymers include the FUSABOND® series from DuPont, which includes FUSABOND® 525D, 524D, 494D, and 499D. Suitable commercially available TPE copoly(ester-ethers) include the HYTREL® series from DuPont, which includes HYTREL® 3078, G3548W, 4056, G4078W and 6356; the LOMOD metallocene-catalyzed polymers series from General Electric, which includes LOMOD® ST3090A and TE3055A; ARNITEL® and URAFIL® from Akzo; ECDEL® from Eastman Kodak; and RITEFLEX® from Hoechst Celanese. One suitable type of polyamide material for the outer cover layer is the PEBAX® series, available from Elf-Atochem S.A. of France, which includes PEBAX® 2533, 3533, 4033 and 6333.

Ionomers are copolymers or terpolymers of ethylene and methacrylic acid or acrylic acid at least partially neutralized with salts of zinc, sodium, lithium, magnesium, potassium, calcium, manganese, nickel or the like, in which the salts are the reaction product of an olefin having from 2 to 8 carbon atoms and an unsaturated monocarboxylic acid having 3 to 8 carbon atoms. The carboxylic acid groups of the copolymer can be neutralized from 0 to 100 percent and might include methacrylic, crotonic, maleic, fumaric or itaconic acid.

Examples of highly or fully neutralized ionomers include highly neutralized polymers with ethylene, $C_3$ to $C_8$ α, β-ethylenically unsaturated carboxylic copolymers. These polymers may be made by incorporating a sufficient amount of specific organic acid (or salt) before neutralization. A process for making such polymers is disclosed in International Publication Nos. WO/0023519 and WO/0129129, which are incorporated in their entirety by reference herein.

In one preferred embodiment, the inner cover layer 30 includes a blend of 50 weight percent SURLYN® 8940 (Na neutralized) and 50 weight percent SURLYN® 7940 (Li neutralized). In another embodiment, the inner cover layer can include one or more polyureas, which can be prepared by reacting an organic isocyanate and an organic amine, each having two or more functional groups. Particularly useful isocyanates include aliphatic, arylaliphatic, and aromatic isocyanates, which in one embodiment include an isocyanate content of at least about 29%. In one preferred embodiment, the isocyanate can be present in an amount of about 29 to 34 weight percent. Typical amine-curing agents for use in a polyurea include one or more organic diamines and triamines. Aromatic diamines are preferred. Particularly suitable polyurea materials include those described in U.S. Pat. No. 5,484,870, the disclosure of which is incorporated herein by express reference thereto.

To create a moisture vapor barrier layer in accordance with one aspect of the invention, the inner cover can be formed of a polybutadiene rubber, a cross-linking agent, a free radical source, and high specific gravity fillers.

Fillers can be added, as discussed above, to adjust the properties of the inner cover layer. In one embodiment, the weight of the inner cover should be increased as much as possible to increase the moment of inertia of the ball. Preferred fillers are those that have a small particle size and high specific gravity, such as tungsten. In some instances, it can be desirable to increase the weight of the inner cover as much as possible, thereby increasing the moment of inertia, while retaining the resilience and durability.

In one embodiment, the outer diameter of the inner cover layer is from about 1.55 inches to 1.67 inches. In another embodiment, the outer diameter is from about 1.6 inches to 1.67 inches and, more preferably, about 1.66 inches to about 1.67 inches. The inner cover layer preferably has a thickness of about 0.01 inches to about 0.25 inches, preferably about 0.025 to about 0.01 inches, and more preferably about 0.03 inches to about 0.05 inches. In one preferred embodiment, the thickness of the inner cover layer is about 0.032 inches to 0.038 inches. In another aspect of the invention, the inner cover layer acts as a moisture vapor barrier layer and preferably has a thickness less than about 0.03 inches.

The inner cover layer hardness is preferably about 10 to 80 Shore D, preferably about 30 to 70 Shore D, and more preferably about 35 to 65 Shore D when measured in plaque form. The hardness is measured in plaque form, i.e., a slab of the unfilled material, and will have a slightly lower hardness than if the material was measured as a filled or reinforced material.

The compression of the inner cover layer is typically from about 20 to 100, preferably from about 50 to 95. In one preferred embodiment, the inner cover layer compression is from about 75 to 90.

In one embodiment, the inner cover layer has a specific gravity of about 0.8 to 1.3, preferably about 0.9 to 1.1. In one embodiment, the weight of the partly formed golf ball including inner cover layer is about 40 g to 46 g, preferably about 40 to 42 g. The loss tangent of the inner cover layer can, in one embodiment, be from about 0.03 to 0.08 from a temperature of about −30° C. to 20° C. The elasticity and complex modulus of the inner cover layer can be from about 5,000 to 12,000 Kgf/cm$^2$ over a temperature of about −30° C. to 20° C.

Centers/Cores

The golf ball can include any suitable material known in the art to form the center or core. The center composition preferably includes at least one rubber material, preferably polybutadiene or a reaction product thereof, as disclosed in co-pending U.S. patent application Ser. No. 09/775,793, which is incorporated in its entirety by reference herein.

In one embodiment, at least one of the center layers includes a reaction product that includes a cis-to-trans catalyst, a resilient polymer component having polybutadiene, a free-radical source, and optionally, a crosslinking agent, a filler, or both. Various combinations of polymers, cis-to-trans catalysts, fillers, crosslinkers, and a source of free radicals, can be used to convert the cis-isomer of the polybutadiene resilient polymer component to the trans-isomer during a molding cycle. As used herein, "cis-to-trans catalyst" means any component or a combination thereof that will convert at least a portion of cis-polybutadiene isomer to trans-polybutadiene isomer at a given temperature. It should be understood that the combination of the cis-isomer, the trans-isomer, and any vinyl-isomer, measured at any given time, comprises 100 percent of the polybutadiene. For example, to obtain a higher resilience and lower compression center, a high-molecular weight polybutadiene with a cis-isomer content preferably greater than about 90 percent is converted to increase the percentage of trans-isomer content at any point in the golf ball or portion thereof. More preferably, the cis-polybutadiene isomer is present in an amount of greater than about 95 percent of the total polybutadiene content. In another embodiment, about 7 percent or less 1,2-polybutadiene isomer ("vinyl-polybutadiene") is desired in both the initial polybutadiene and the reaction product. Preferably, the vinyl polybutadiene isomer content is about 4 percent or less and, more preferably, about 2 percent or less.

The cis-to-trans catalyst is preferably present in an amount from about 0.1 to 10 parts per hundred of the total resilient polymer component. As used herein, the term "parts per hundred," also known as "phr," is defined as the number of parts by weight of a particular component present in a mixture, relative to 100 parts by weight of the total polymer component. Mathematically, this can be expressed as the weight of an ingredient divided by the total weight of the polymer, multiplied by a factor of 100. More preferably, the cis-to-trans catalyst is present in an amount from about 0.1 to 8 parts per hundred of the total resilient polymer component and even more preferably about 0.1 to 5 parts per hundred.

The cis-to-trans catalyst can include an organosulfur or metal-containing organosulfur compound, a substituted or unsubstituted aromatic organic compound that does not contain sulfur or metal, an inorganic sulfide compound, an aromatic organometallic compound, or mixtures thereof. Examples of organosulfur compounds are disclosed in co-pending U.S. patent application Ser. No. 09/461,736, which is incorporated in its entirety by reference herein. Suitable substituted or unsubstituted aromatic organic components that do not include sulfur or a metal include, but are not limited to, 4,4'-diphenyl acetylene, azobenzene, or a mixture thereof. Suitable inorganic sulfide components include, but are not limited to titanium sulfide, manganese sulfide, and sulfide analogs of iron, calcium, cobalt, molybdenum, tungsten, copper, selenium, yttrium, zinc, tin, and bismuth. Suitable substituted or unsubstituted aromatic organic components include, but are not limited to, components having the formula $(R_1)_x$—$R_3$-M-$R_4$—$(R_2)_y$, wherein $R_1$ and $R_2$ are each hydrogen or a substituted or unsubstituted $C_{1-20}$ linear, branched, or cyclic alkyl, alkoxy, or alkylthio group, or a single, multiple, or fused ring $C_6$ to $C_{24}$ aromatic group; x and y are each an integer from 0 to 5; $R_3$ and $R_4$ are each selected from a single, multiple, or fused ring $C_6$ to $C_{24}$ aromatic group; and M includes an azo group or a metal component. $R_3$ and $R_4$ are each preferably selected from a $C_6$ to $C_{10}$ aromatic group, more preferably selected from phenyl, benzyl, naphthyl, benzamido, and benzothiazyl. $R_1$ and $R_2$ are each preferably selected from a substituted or unsubstituted $C_{1-10}$ linear, branched, or cyclic alkyl, alkoxy, or alkylthio group or a $C_6$ to $C_{10}$ aromatic group. When $R_1$, $R_2$, $R_3$, or $R_4$, are substituted, the substitution can include one or more of the following substituent groups: hydroxy and metal salts thereof; mercapto and metal salts thereof; halogen; amino, nitro, cyano, and amido; carboxyl including esters, acids, and metal salts thereof; silyl; acrylates and metal salts thereof; sulfonyl or sulfonamide; and phosphates and phosphites. When M is a metal component, it can be any suitable elemental metal available to those of ordinary skill in the art. Typically, the metal will be a transition metal, although preferably it is tellurium or selenium. In one embodiment, the aromatic organic compound is substantially free of metal, while in another embodiment the aromatic organic compound is completely free of metal. The cis-to-trans catalyst can also include a Group VIA component. As used herein, the terms "Group VIA component" or "Group VIA element" mean a component that includes a sulfur component, a selenium component, or a tellurium component, or a combination thereof. As used herein, the term "sulfur component" means a component that is elemental sulfur, polymeric sulfur, or a combination thereof. It should be further understood that "elemental sulfur" refers to the ring structure of $S_8$ and that "polymeric sulfur" is a structure including at least one additional sulfur relative to the elemental sulfur.

A free-radical source, often alternatively referred to as a free-radical initiator, is required in the composition and method. The free-radical source is typically a peroxide, and preferably an organic peroxide. Suitable free-radical sources include di-t-amyl peroxide, di(2-t-butyl-peroxyisopropyl) benzene peroxide, 3,3,5-trimethyl cyclohexane, a-a bis (t-butylperoxy) diisopropylbenzene, 1,1-bis(t-butylperoxy)-3,3,5-trimethylcyclohexane, dicumyl peroxide, di-t-butyl peroxide, 2,5-di-(t-butylperoxy)-2,5-dimethyl hexane, n-butyl-4,4-bis(t-butylperoxy)valerate, lauryl peroxide, benzoyl peroxide, t-butyl hydroperoxide, and the like, and any mixture thereof. The peroxide is typically present in an amount greater than about 0.1 parts per hundred of the total polybutadiene composition, preferably about 0.1 to 15 parts per hundred of the resilient polymer component, and more preferably about 0.2 to 5 parts per hundred of the total polybutadiene composition. The free radical source can alternatively or additionally be one or more of an electron beam, UV or gamma radiation, x-rays, or any other high energy radiation source capable of generating free radicals.

A crosslinking agent can also be included to increase the hardness of the reaction product. Suitable crosslinking agents include one or more metallic salts of unsaturated fatty acids or monocarboxylic acids, such as zinc, aluminum, sodium, lithium, nickel, calcium, or magnesium acrylate salts, and the like, and mixtures thereof. Preferred acrylates include zinc acrylate, zinc diacrylate, zinc methacrylate, and zinc dimethacrylate, and mixtures thereof. The crosslinking agent is typically present in an amount greater than about 0.1 percent of the total polybutadiene composition, preferably from about 10 to 40 percent of the total polybutadiene composition, more preferably from about 10 to 30 percent of the total polybutadiene composition.

Fillers useful in the golf ball core according to the present invention include, for example, zinc oxide, barium sulfate, flakes, fibers, and regrind, which is ground, recycled core material (for example, ground to about 30 mesh particle size). The amount and type of filler utilized is governed by the amount and weight of other ingredients in the composition, since a maximum golf ball weight of 45.93 g (1.62 ounces)

has been established by the United States Golf Association (USGA). Appropriate fillers generally used have a specific gravity from about 2 to 20. In one preferred embodiment, the specific gravity can be about 2 to 6. In one embodiment, the center material can have a specific gravity of about 1 to 5, preferably about 1.1 to 2.

Antioxidants can also optionally be included in the polybutadiene material in the centers produced according to the present invention. Antioxidants are compounds that can inhibit or prevent the oxidative degradation of the polybutadiene. Antioxidants useful in the present invention include, but are not limited to, dihydroquinoline antioxidants, amine type antioxidants, and phenolic type antioxidants.

Other optional ingredients, such as accelerators, e.g., tetramethylthiuram, peptizers, processing aids, processing oils, plasticizers, dyes and pigments, as well as other additives well known to those of ordinary skill in the art can also be used in the present invention in amounts sufficient to achieve the purpose for which they are typically used.

The polybutadiene material used in the center preferably has a hardness of at least about 15 Shore A, more preferably from about 30 Shore A to 80 Shore D, and even more preferably from about 50 Shore A to 60 Shore D. In one preferred embodiment, the center has a hardness of about 20 to 85 Shore C, preferably from about 40 to 80 Shore C, and more preferably from about 60 to 70 Shore C at the geometric center of the golf ball center. The surface of the golf ball center is typically harder than at the geometric center of the golf ball center. For example, a golf ball center, i.e., a sphere, having a hardness of 65 Shore C at its center might have a hardness of about 80 to 85 Shore C at its surface. The specific gravity is typically greater than about 0.7, preferably greater than about 1, for the golf ball polybutadiene material.

Additionally, the unvulcanized rubber, such as polybutadiene, in golf balls prepared according to the invention typically has a Mooney viscosity of about 40 to about 80, preferably from about 45 to about 60, and more preferably from about 45 to about 55. Mooney viscosity is typically measured according to ASTM D 1646-99.

In one embodiment, the center has an outer diameter of at least about 1.3 inches, preferably from about 1.3 inches to about 1.59 inches. In one preferred embodiment, the center has an outer diameter of about 1.34 to about 1.55 inches.

The resilience index of the rubber used in the center composition is preferably about 40 or less and, more preferably, about 50 or less. The polybutadiene reaction product preferably has a loss tangent below about 0.1 at −50° C., and more preferably below about 0.07 at −50° C.

The rigidity or compressive stiffness of a golf ball can be measured, for example, by the dynamic stiffness. A higher dynamic stiffness indicates a higher compressive stiffness. In one embodiment, crosslinked polybutadiene reaction product has a dynamic stiffness of less than about 50,000 N/m at −50° C. Preferably, the dynamic stiffness should be from about 10,000 to 40,000 N/m at −50° C., more preferably, the dynamic stiffness should be from about 20,000 to 30,000 N/m at −50° C. In another embodiment, the reaction product has a first dynamic stiffness measured at −50° C. that is less than about 130 percent of a second dynamic stiffness measured at 0° C. More preferably, the first dynamic stiffness is less than about 125 percent of the second dynamic stiffness. Most preferably, the first dynamic stiffness is less than about 110 percent of the second dynamic stiffness.

In another embodiment, the center of the ball is a fluid-filled sphere or shell. As used herein, the term "fluid" can include air, gas, water solutions, gels, foams, hot-melts, other fluid materials and combinations thereof, such as those set forth in U.S. Pat. No. 5,683,312, which is incorporated herein by reference. The envelope or shell containing the fluid can be a rubber sack, a thermoplastic, or metallic shell design.

Optional Wound Layer

In one embodiment, a wound layer of tensioned material is disposed about the center, optionally with one or more layers disposed therebetween. The tensioned materials can include, but are not limited to, polyisoprene, polyether urea, polyester, polyethylene, polypropylene, or combinations thereof can be used with the present invention. A thread that does not exhibit softening during molding, such as polyisoprene, can be used with the present invention. In another embodiment, a thread that "softens" during the compression and/or injection molding cycles, creating an intermediate layer or a fused cover, such as polyether urea could be used. The wound layer preferably has an outer diameter of at least about 1.51 inches.

Threads used in the present invention can be formed using a variety of processes including conventional calendering and slitting. Furthermore, processes such as melt spinning, wet spinning, dry spinning or polymerization spinning can also be used to provide threads. Melt spinning is a highly economic process. Polymers are extruded through spinnerets by a heated spin pump. The resulting fibers are drawn off at rates up to 1200 meters/minute. The fibers are drawn and allowed to solidify and cool in the air. Because of the high temperatures required, only melting and thermally stable polymers can be melt spun. These polymers include poly(olefins), aliphatic polyamides, and aromatic polyesters, all of which are suitable thread materials.

For polymers that decompose on melting, the wet spinning method is used. Solutions of about 5 percent to about 20 percent are passed through the spinnerets by a spin pump. A precipitation bath is used to coagulate the filaments and a drawing or stretching bath is used to draw the filaments. Filament production rates under this method are lower than melt spinning, typically about 50 to about 100 meters/minute. Because of solvent recovery costs, this method is less economical.

In dry spinning, air is the coagulating bath. The method is usable for polymers that decompose on melting, however only when readily volatile solvents are known for the polymers. Solutions of about 20 percent to about 55 percent are used. After leaving spinneret orifices, resulting filaments enter a chamber having a length of about 5 meters to about 8 meters. In the chamber, jets of warm air are directed toward the filaments. This causes the solvent to evaporate and the filaments to solidify. The process has higher rates of spinning than the wet spinning process. Typically, filament production rates are about 300 to about 500 meters/minute. The initial capital investment of equipment is higher, but the operation costs are lower than in wet spinning. Further, this process is only usable for spinning polymers for which readily volatile solvents are known.

In another method of spinning, polymerization spinning, a monomer is polymerized together with initiators, fillers, pigments, and flame retardants, or other selected additives. The polymerizate is directly spun at rates of about 400 m/min. The polymerizate is not isolated. Only rapidly polymerizing monomers are suitable for this method. For example, LYCRA® is produced by polymerization spinning.

Single-ply, two-ply, or multi-ply threads are usable with the present invention. Threads formed of multiple strands can be prepared according to the invention by reference to U.S. Pat. No. 6,149,535, the entire disclosure of which is hereby incorporated herein by reference.

In yet another embodiment, a hoop-stress layer is disposed about center, either alternatively or in addition to a wound layer as described above. The inner diameter is preferably about 1.55 inches or greater, and more preferably about 1.58 inches to about 1.62 inches. The hoop-stress layer is formed of high tensile fiber wound about the inner core and preferably in contact with the inner core and can include a variety of high tensile modulus fibers, e.g., glass, polyamide, aromatic polyamide, carbon, or metal fibers. A hoop layer created from metal fiber can have an increased moment of inertia, and thus can rotate at a slower speed when struck with a golf club and can thus retain its rotational velocity longer during flight.

The strength of these high tensile elastic modulus fibers is preferably high to accommodate the extremely high stresses placed upon the golf ball windings when struck with a golf club. It can be varied, however, to provide a golf ball with a good feel and durability. A tensile strength of at least about 250,000 psi is preferred, however, a tensile strength of at least about 500,000 psi is more preferred. The tensile elastic modulus of the high tensile elastic modulus fiber along with its gauge or thickness can also be varied to provide a stiffer, a softer, or a more durable ball as desired. A modulus of at least about 10,000,000 psi is preferred, and 20,000,000 psi is more preferred. The hoop layer is preferably wound to a thickness of about 0.01 to 0.10 inches. In one hoop layer embodiment, an initial strain of at least 100% is preferred on the tensioned material.

Optional Intermediate Layer

In one embodiment, which further includes an additional intermediate layer between the center and the cover layer, the intermediate layer includes a material formed from a conversion reaction of polybutadiene having a first amount of trans-polybutadiene, a free radical source, and a cis-to-trans catalyst includes at least one organosulfur component, wherein the intermediate layer has an outer diameter of at least about 1.58 inches, and wherein the center has an outer diameter of about 1.55 inches or less.

Ball Construction

The golf balls of the present invention can be made by any conventional process employed in the golf ball art. For example, a golf ball with a solid center can be manufactured by injection or compression molding the solid center. A golf ball of the invention can also be formed by initially compression molding hemispherical cups, bonding the cups together to form the center and filling the cavity with fluid or liquid to form a fluid filled center. This process can also be used with a solid center, wherein the cups form an intermediate layer around the center. In the case of a wound center, the threads are then wound about the center to form the wound layer as previously described. The cover layers can then be disposed about the center layers, such as by injection, compression molding, casting, or a combination thereof.

The inner cover layer can be prepared in a variety of ways. Although injection or compression molding, or casting, can be used, in one embodiment, the inner cover is formed by compression molding. A suitable speed for increasing the pressure to close the molds around the centers can be readily determined, bearing in mind that too rapid an increase in pressure on the molds and centers therein can cause the centers to fracture and/or break, e.g., less than 1 second. Thus, a time on the order of greater than 1 second to about 30 seconds, preferably 2 seconds to 20 seconds can be suitable depending on other process conditions and the materials involved. In one preferred embodiment, a time of 15 seconds is most suitable for closing the mold. It should be understood that this time is measured from when each half of the mold is in contact with the material therebetween and relates to the time over which the pressure on the molds and centers is increased to fully close the molds. This method advantageously helps inhibit or avoid weld lines that can occur using injection molding methods.

In another embodiment, the inner cover layer is injection molded about the center with a high rate injection mold, i.e., a 14 inch per second screw injection speed. Such equipment can be obtained from Krauss Maffei Machines in Munich, Germany. A cycle time of about 20 seconds to 30 seconds can be used. This rapid injection molding method advantageously strengthens weld lines.

The inner cover can, but is not required to be, vulcanized as it is applied to the core, or in a post molding step. The outer surface of the inner cover layer can be treated prior to application of the outer cover, by one or more of halogenation, chemical surface modification or treatment, UV radiation, electron beam exposure, microwave radiation, coating (via spray, dip, or electrostatic application), plasma, or corona discharge, as described in co-pending U.S. patent application Ser. No. 09/389,058, which is incorporated herein by express reference thereto. Preferably, the treatment will increase adhesion of the inner cover layer to the outer cover and soften the base material. The treatment can be used to activate a material compounded into the base material which will have the same preferred interaction with the outer cover to facilitate, for example, adhesion. The treatment can further be used to activate a material such that the softening point of the base material is increased, improving the temperature stability of the final product.

Additional layers can optionally be present between the inner and outer cover layers, and in such case the outer surface of the layer adjacent to the outer cover layer can be treated rather than the inner cover layer, or in addition to the inner cover layer.

The outer cover layer is preferably formed around the inner components of the ball mixing and introducing the material in the mold halves. It is important that the viscosity be measured over time, so that the subsequent steps of filling each mold half, introducing the core into one half and closing the mold can be properly timed for accomplishing centering of the core cover halves fusion and achieving overall uniformity. A suitable viscosity range of the curing urethane mix for introducing cores into the mold halves is determined to be approximately from about 2,000 cP to about 30,000 cP, with the preferred range of about 8,000 cP to about 15,000 cP.

To start the cover formation, mixing of the prepolymer and curative can be accomplished in motorized mixer including mixing head by feeding through lines metered amounts of curative and prepolymer. Top preheated mold halves are filled and placed in fixture units using pins moving into holes in each mold. After the reacting materials have resided in top mold halves for about 50 to about 80 seconds, a core is lowered at a controlled speed into the gelling reacting mixture. At a later time, a bottom mold half or a series of bottom mold halves have similar mixture amounts introduced into the cavity.

A ball cup can hold the ball core through reduced pressure (or partial vacuum) in hose. Upon location of the coated core in the halves of the mold after gelling for about 50 to about 80 seconds, the vacuum is released allowing core to be released. The mold halves, with core and solidified cover half thereon, are removed from the centering fixture unit, inverted and mated with other mold halves which, at an appropriate time earlier, have had a selected quantity of reacting polyurethane prepolymer and curing agent introduced therein to commence gelling.

If a castable, reactive liquid is employed to form a urethane outer cover layer, the material can be applied over the inner components using a variety of application techniques such as spraying, dipping, spin coating, or flow coating methods which are well known in the art. U.S. Pat. Nos. 5,006,297 and 5,334,673 both also disclose suitable molding techniques which can be utilized to apply the castable reactive liquids employed in the present invention. Another example of a suitable coating technique is disclosed in U.S. Pat. No. 5,733,428, which is incorporated by reference in its entirety. The method of the invention, however, is not limited to the use of these techniques.

When golf balls are prepared according to the invention, they typically will have dimple coverage greater than about 60 percent, preferably greater than about 65 percent, and more preferably greater than about 75 percent.

Depending on the desired properties, balls prepared according to the invention can exhibit substantially the same or higher resilience, or coefficient of restitution ("COR"), with a decrease in compression or modulus, compared to balls of conventional construction. Additionally, balls prepared according to the invention can also exhibit substantially higher resilience, or COR, without an increase in compression, compared to balls of conventional construction.

In one embodiment for low swing speed players, the coefficient of restitution of the golf ball at a club head speed of 160 ft/s is at least about 0.76 and the magnitude of the gradient of the coefficient of restitution to an inbound velocity is at least about 0.001 s/ft.

Methods for measuring the resiliency of golf balls are well known by those of ordinary skill in the art. One method of measuring the resiliency of a ball at impact is to utilize an air cannon or other means of propelling a ball at velocities equivalent to those of a golf club head. The balls are fired at a massive rigid block, with the inbound and outbound velocities being measured. The velocity can be measured by the use of light screens, which measure the time required for the ball to travel a fixed distance. The fixed distance divided by the transit time is equivalent to the average velocity of the ball over the fixed distance. The ratio of the outbound velocity to the inbound velocity is commonly referred to as the coefficient of restitution ("COR"). The COR is a direct measure of the resilience of a golf ball at a particular inbound velocity. Since golf balls behave in a linear-viscoelastic fashion, inbound ball velocity is functionally equivalent to club swing speed. In one embodiment, the present invention seeks to maximize the COR for low swing speed players. These players swing the club at the ball with low swing speeds, and thus tend to obtain lower ball velocity after impact and less distance off the tee.

The resultant golf balls typically have a coefficient of restitution of greater than about 0.7, preferably greater than about 0.75, and more preferably greater than about 0.78. As used herein, the term "coefficient of restitution" ("COR") for golf balls is defined as the ratio of the rebound velocity to the inbound velocity when balls are fired into a rigid plate. The inbound velocity is understood to be 125 ft/s.

The golf balls also typically have an Atti compression (which has been referred to as PGA compression in the past) of at least about 40, preferably from about 50 to 120, and more preferably from about 60 to 100. The golf ball polybutadiene material of the present invention typically has a flexural modulus of from about 500 psi to 300,000 psi, preferably from about 2000 to 200,000 psi. The golf ball polybutadiene material of the present invention typically has a flexural modulus of from about 500 psi to 300,000 psi, preferably from about 2000 to 200,000 psi.

EXAMPLES

These and other aspects of the present invention can be more fully understood with reference to the following examples, which are merely illustrative of the preferred embodiment of the present invention golf ball construction. The examples are not to be construed as limiting the invention.

Examples 1-5

Golf Ball Cores Using Various Rubber Formulations

A variety of cores were prepared according to the present invention, as well as some cores prepared using conventional materials. All cores in Table 1 were prepared to a diameter of 1.58 inches. The recipes for each core, as well as the compression for each core formulation, are presented in Table 1 below:

TABLE 1

Golf Ball Core Properties from Various Rubber Formulations

| Ingredients | Mooney viscosity @ 100° C. | Ex. 1 | Ex. 2 | Ex. 3 | Ex. 4 | Ex. 5 |
|---|---|---|---|---|---|---|
| CB23 | 51 | 100 | | | | |
| CB22 | 63 | | 100 | | | |
| BR-60 | 60 | | | 100 | | |
| Taktene 8855 | 48 | | | | 100 | |
| CARIFLEX BR1220 | 43 | | | | | 100 |
| Zinc diacrylate (phr) | | 28 | 28 | 28 | 28 | 28 |
| Peroxide (phr) | | 0.53 | 0.53 | 0.53 | 0.53 | 0.53 |
| Zinc oxide (phr) | | 4.3 | 4.3 | 4.3 | 4.3 | 4.3 |
| Tungsten (phr) | | 11 | 11 | 11 | 11 | 11 |
| | | Core Properties | | | | |
| Compression | | 77 | 75 | 77 | 76 | 71 |

A variety of metal sulfide cis-to-trans catalysts that successfully converted a portion of the cis-polybutadiene isomer to the trans-isomer are presented in Table 2. CARIFLEX BR1220 polybutadiene (100 phr) was reacted with zinc oxide (5 phr), dicumyl peroxide (3 phr, the free radical initiator), and zinc diacrylate (25 phr), to form a reaction product according to the present invention.

Trans-isomer conversion percentages range from below 8 percent to above 17 percent for the various catalysts that are present in amounts ranging from below 1.7 phr to above 3.7 phr. Table 3 demonstrates the effectiveness of numerous different cis-to-trans catalysts, at varying concentrations, for increasing the trans-polybutadiene content.

TABLE 2

Metal Sulfide Conversion Examples

| | | | | | | | | | | | | | | |
|---|---|---|---|---|---|---|---|---|---|---|---|---|---|---|
| CARIFLEX BR1220 | | 100 | 100 | 100 | 100 | 100 | 100 | 100 | 100 | 100 | 100 | 100 | 100 | 100 |
| Zinc oxide | | 5 | 5 | 5 | 5 | 5 | 5 | 5 | 5 | 5 | 5 | 5 | 5 | 5 |
| Dicumyl peroxide | | 3 | 3 | 3 | 3 | 3 | 3 | 3 | 3 | 3 | 3 | 3 | 3 | 3 |
| Zinc Diacrylate | | 25 | 25 | 25 | 25 | 25 | 25 | 25 | 25 | 25 | 25 | 25 | 25 | 25 |
| Cis-to-Trans "Catalyst" | FeS | 2.87 | | | | | | | | | | | | |
| | MnS | | 2.65 | | | | | | | | | | | |
| | $TiS_2$ | | | 1.70 | | | | | | | | | | |
| | CaS | | | | 2.20 | | | | | | | | | |
| | CoS | | | | | 2.77 | | | | | | | | |
| | $MoS_2$ | | | | | | 2.43 | | | | | | | |
| | $WS_2$ | | | | | | | 3.77 | | | | | | |
| | $Cu_2S$ | | | | | | | | 4.65 | | | | | |
| | $SeS_2$ | | | | | | | | | 2.19 | | | | |
| | $Y_2S_3$ | | | | | | | | | | 2.76 | | | |
| | ZnS | | | | | | | | | | | 2.97 | | |
| | $Sb_2S_3$ | | | | | | | | | | | | 3.45 | |
| | $Bi_2S_3$ | | | | | | | | | | | | | 5.22 |
| % Trans BR isomer Precure | | 1.5 | 1.5 | 1.5 | 1.5 | 1.5 | 1.5 | 1.5 | 1.5 | 1.5 | 1.5 | 1.5 | 1.5 | 1.5 |
| % Trans BR isomer Postcure | | 10.5 | 16.1 | 17.0 | 8.3 | 10.3 | 10.1 | 9.2 | 5.8 | 5.2 | 10.2 | 10.1 | 10.7 | 10.5 |

Example 6

Cores with an Organosulfur Cis-to-Trans Catalyst

Cores were created according to the present invention employing an organosulfur compound as the cis-to-trans conversion catalyst. The resultant core properties demonstrate the advantages of a golf ball core made according to the current invention, as compared to conventional cores. The components and physical characteristics are presented in Table 3. The compressive load of a core prepared according to the invention is approximately half of the compressive load of cores constructed in accordance with U.S. Pat. Nos. 5,697,856, 5,252,652, and 4,692,497, while at the same time having roughly the same, and in some cases higher, COR (resilience). The cores made according to the current invention have a lower compressive load (soft), yet are resilient (fast). The compressive load is greater than that of a core constructed in accordance with U.S. Pat. No. 3,239,228, but has a significantly higher COR. The core of U.S. Pat. No. 3,239,228 is very soft and very slow (very low COR).

The percent change in dynamic stiffness from 0° C. to −50° C. was also measured at both the edge and center of the core. The dynamic stiffness at both the edge and the center of the core of the current invention varied only slightly, less than 20 percent, over the temperature range investigated. The core made according to U.S. Pat. No. 3,239,228 varied over 230 percent, whereas the cores made according to other conventional technology, had a dynamic stiffness that varied by greater than 130 percent, and typically by as much as 150 percent, over the same temperature range.

The percent of trans-isomer conversion was also measured at both the center and edge of the core prepared according to the current invention, and for cores prepared as disclosed in the same four patents mentioned above, allowing a trans-gradient to be calculated. The core according to the current invention had a trans-gradient of about 32 percent from edge to center. For the cores prepared according to the current invention, the pre- and post-cure trans-percentages were also measured to determine the effectiveness of that process. The percentage of polybutadiene converted to the trans-isomer ranged from almost 40 percent at the center to greater than 55 percent at the edge. Two of the cores prepared according to conventional technology, U.S. Pat. Nos. 3,239,228 and 4,692,497, had a zero trans-gradient. A third core, prepared according to U.S. Pat. No. 5,697,856, had only a slight trans-gradient, less than 18 percent from edge to center. A fourth core, prepared according to U.S. Pat. No. 5,252,652, had a very large gradient, almost 65 percent from edge to center.

Example 8

Cores with an Inorganic Sulfide Cis-to-trans Catalyst

Cores were created employing an inorganic sulfide compound as the cis-to-trans conversion catalyst. The resultant core properties clearly demonstrate the advantages of a golf ball core made according to the current invention as compared to example cores constructed with conventional technology. The components and physical characteristics are presented in Table 3.

The compressive load is approximately half of the compressive load of three cores constructed in accordance with U.S. Pat. Nos. 5,697,856, 5,252,652, and 4,692,497, while at the same time retaining roughly the same, and in some cases, a higher COR (resilience). The core made according to the current invention is soft, yet resilient (fast). The compressive load is greater than a core constructed in accordance with U.S. Pat. No. 3,239,228, but has a significantly higher COR. The core of U.S. Pat. No. 3,239,228 is very soft and very slow (low COR).

The percent change in dynamic stiffness from 0° C. to −50° C. was also measured at both the edge and center of the cores. The dynamic stiffness at both the edge and the center of the core of the current invention varied only slightly, less than 125 percent, over the temperature range investigated. The core made according to U.S. Pat. No. 3,239,228 varied over 230 percent, whereas the cores made according to other conventional technology, had a dynamic stiffness that varied by greater than 130 percent, and typically by as much as 150 percent, over the same temperature range.

The percent of trans-conversion was also measured at both the center and edge of the core prepared according to the current invention, and for cores prepared according to the same four patents mentioned above, allowing a trans-gradient to be calculated. The core according to the current invention had a trans-gradient of about 45 percent from edge to center. Two of the cores prepared in accordance with U.S. Pat. Nos. 3,239,228 and 4,692,497 had a zero trans-gradient. A third core, prepared in accordance with U.S. Pat. No. 5,697,856, had only a slight trans-gradient, less than 18 percent from edge to center. A fourth core, prepared in accordance with U.S. Pat. No. 5,252,652, had a very large gradient, almost 65 percent, from edge to center.

Example 8

Cores with a Blend of Cis-to-trans Catalysts

Cores were created employing a blend of organosulfur and inorganic sulfide compounds as the cis-to-trans conversion catalyst. The resultant core properties clearly demonstrate the advantages of a golf ball core made according to the current invention as compared to example cores constructed with conventional technology. The components and physical characteristics are presented in Table 3.

The compressive load is approximately half of the compressive load of three cores constructed in accordance with U.S. Pat. Nos. 5,697,856, 5,252,652, and 4,692,497, while at the same time retaining roughly the same, and in some cases a higher COR (resilience). The core made according to the current invention is soft, yet resilient (fast). The compressive load of the invention is greater than a fourth core constructed in accordance with U.S. Pat. No. 3,239,228, but has a significantly higher COR. The core constructed in accordance with U.S. Pat. No. 3,239,228 is very soft and very slow (low COR).

The percent change in dynamic stiffness from 0° C. to −50° C. was also measured at both the edge and center of the cores. The dynamic stiffness at both the edge and the center of the core of the current invention varied only slightly, less than 121 percent, over the temperature range investigated. The core made in accordance with U.S. Pat. No. 3,239,228 varied over 230 percent, whereas the cores made according to other conventional technology had a dynamic stiffness that varied by greater than 130 percent, and typically by as much as 150 percent, over the same temperature range.

The percent of trans-conversion was also measured at both the center and edge of the core prepared according to the current invention, and for cores prepared to the same four patents mentioned above, allowing a trans-gradient to be calculated. The core according to the current invention had a trans-gradient that about 44 percent from edge to center. For the core prepared according to the current invention, the pre- and post-cure trans-percentages was also measured to determine the effectiveness of that process. The percentage of polybutadiene converted to the trans-isomer ranged from almost 26 percent at the center to greater than 45 percent at the edge. Two of the cores prepared in accordance with U.S. Pat. Nos. 3,239,228 and 4,692,497 had a zero trans-gradient. A third core prepared in accordance with U.S. Pat. No. 5,697,856 had only a slight trans-gradient, less than 18 percent from edge to center. A fourth core, prepared in accordance with U.S. Pat. No. 5,252,652 had a very large gradient, almost 65 percent from edge to center.

TABLE 3

| | Cis-to-Trans Conversion with Organosulfur Catalyst | | | | | | |
|---|---|---|---|---|---|---|---|
| | | | | Conventional Golf Balls | | | |
| | Examples | | | | US #5816944 | | US#4971329 |
| Chemical Constituents | #6 | #7 | #8 | US#3239228 | US#5697856 | US#5252652 | US#4692497 |
| Polybutadiene (Shell, CARIFLEX BR1220) | 100 | 100 | 100 | | N/A | N/A | N/A |
| Polybutadiene (Firestone, 35 NF) | | | | 100 | N/A | N/A | N/A |
| DMDS | | | | 2.1 | N/A | N/A | N/A |
| Carbon Black (RA) | | | | 15 | N/A | N/A | N/A |
| Wood Flour | | | | 24 | N/A | N/A | N/A |
| Sulfur | | | | 24 | N/A | N/A | N/A |
| Stearic Acid | | | | 1.5 | N/A | N/A | N/A |
| Reogen | | | | 15 | N/A | N/A | N/A |
| Vanox MBPC | | | | 2 | N/A | N/A | N/A |
| Triethanolamine | | | | 4 | N/A | N/A | N/A |
| Zinc oxide | 5 | 5 | 5 | 5 | N/A | N/A | N/A |
| Dicumyl peroxide | 3 | 1.9 | 2 | | N/A | N/A | N/A |
| Zinc Diacrylate | 25 | 25 | 25 | | N/A | N/A | N/A |
| Cis-Trans "Catalyst" | | | | | N/A | N/A | N/A |
| MnS | | 0.82 | | | N/A | N/A | N/A |
| Ditolyldisulfide | 2.5 | | 1.5 | | N/A | N/A | N/A |
| $Cu_2S$ | | | 1 | | N/A | N/A | N/A |
| Resultant Core Properties | | | | | | | |
| Load(lbs) @10.8% Deflection 1.580" core | 165.5 | 191.4 | 191.8 | 61.1 | 325 | 390 | 480 |
| Coefficient of Restitution @125 ft/s | 0.783 | 0.777 | 0.785 | 0.599 | 0.779 | 0.805 | 0.775 |

TABLE 3-continued

| Cis-to-Trans Conversion with Organosulfur Catalyst | | | | | | | |
|---|---|---|---|---|---|---|---|
| | | | | Conventional Golf Balls | | | |
| | Examples | | | | US #5816944 | | US#4971329 |
| Chemical Constituents | #6 | #7 | #8 | US#3239228 | US#5697856 | US#5252652 | US#4692497 |
| Hardness Shore C | | | | | | | |
| Surface | 61 | 76 | 62 | 35 | 75 | 80 | 80.5 |
| Center | 52 | 52 | 59 | 30 | 70 | 61 | 66.5 |
| Dynamic Stiffness @ 0° C. (N/m) | | | | | | | |
| Edge* | 25338 | 27676 | 28493 | 8312 | 62757 | 83032 | 72235 |
| Center | 20783 | 17390 | 27579 | 8361 | 61071 | 26264 | 50612 |
| Dynamic Stiffness @ −50° C. (N/m) | | | | | | | |
| Edge* | 30265 | 34523 | 34455 | 19394 | 92763 | 109053 | 108242 |
| Center | 23022 | 20603 | 32195 | 18617 | 89677 | 28808 | 83183 |
| Dynamic Stiffness Ratio at −50° C./0° C. | | | | | | | |
| Edge* | 119% | 125% | 121% | 233% | 148% | 131% | 150% |
| Center | 111% | 118% | 117% | 223% | 147% | 110% | 164% |
| Loss Tangent 0° C. | | | | | | | |
| Edge* | 0.024 | 0.027 | 0.024 | 0.074 | 0.039 | 0.037 | 0.045 |
| Center | 0.025 | 0.023 | 0.023 | 0.073 | 0.033 | 0.025 | 0.043 |
| Loss Tangent −50° C. | | | | | | | |
| Edge* | 0.098 | 0.084 | 0.097 | 0.183 | 0.142 | 0.119 | 0.099 |
| Center | 0.067 | 0.071 | 0.085 | 0.180 | 0.129 | 0.059 | 0.095 |
| % Trans BR isomer Precure | 1.5 | 1.5 | 1.5 | 50 | N/A | N/A | N/A |
| % Trans BR isomer Postcure | | | | | | | |
| Surface | 55.8 | 8.4 | 45.5 | 50 | 30.2 | 24.6 | 1.5 |
| Center | 37.8 | 4.6 | 25.5 | 50 | 24.7 | 8.5 | 1.5 |
| % Trans Variation (Surf. − Center)/Surf. | 32% | 45% | 44% | 0% | 18% | 65% | 0% |

*Edge is measured approximately 5 mm from the exterior surface of the measured article.

Example 9

Wound Balls Prepared According to the Invention

A dual core golf ball can be prepared having a solid center, an intermediate layer of a tensioned material surrounding the solid center, and a multilayer cover disposed concentrically around the intermediate layer. The components and physical characteristics are presented below in Table 4.

TABLE 4

| Wound Balls | |
|---|---|
| | Ingredients (phr) |
| Center Composition | |
| CARIFLEX BR1220 | 100 |
| Zinc Diacrylate | 20 |
| Dicumyl Peroxide | 2.5 |
| Zinc Oxide | 39 |
| DTDS | 0.75 |
| Center Properties | |
| % trans Precure | 1.5 |
| % trans Postcure | 40 |
| Load in lbs required (10.8% deflection) | 109 |
| Wound Layer Composition | |
| Cis-Polyisoprene thread | 100 |
| Inner Cover Composition and Properties | |
| Na SURLYN 8945 | 50 |
| Li SURLYN 7940 | 50 |

TABLE 4-continued

| Wound Balls | |
|---|---|
| | Ingredients (phr) |
| Shore D hardness | 68 |
| Thickness | 0.03 in |
| Outer Cover Composition and Properties | |
| MDI Polyurethane | |
| Thickness | 0.03 in |

The center can be created from CARIFLEX BR-1220 polybutadiene as the starting material, the only difference being replacing the VAROX 802-40KE-HP peroxide (a good scorch resistant peroxide with conventional technology) with a DTDS cis-to-trans catalyst of the current invention and dicumyl peroxide. This substitution allows a portion of the polybutadiene material to be converted to the trans-configuration during the molding process. The resulting solid center had an outside diameter of approximately 1.15 inches. The polybutadiene reaction product prepared thereby had a trans-isomer content of 40 percent compared to the 1.5 percent trans-isomer of conventional balls. An intermediate layer, having outside diameter of approximately 1.56 inches, was constructed by winding a thread material under tension around the solid center to form a wound core. The tensioned material includes conventional cis-polyisoprene thread.

Example 10

A Solid Ball Prepared According to the Invention

The center can be formed using any of the cores described in the previous Example 1-9, but preferably using CB23 polybutadiene rubber having about 40 to about 50 Mooney viscosity, a DTDS cis-to-trans catalyst, about 20 to about 35 phr zinc diacrylate, and a tungsten filler to adjust the density of the center. The center can be about 1.5 to about 1.6 inches in diameter. The center compression is desirably about 50 to about 60 and has a deflection of greater than about 3.0 mm under the 130 kg-10 kg test.

An inner cover of ionomer can then be applied of a blend of 50 percent 8945 SURLYN® sodium ionomer and 50 percent 7940 SURLYN® lithium ionomer. The inner cover has a hardness of about 25 to about 75 Shore D. The inner cover is desirably formed to a thickness of about 0.01 to about 0.25 inches. The outer cover can be cast from an MDI-based urethane material having a cured hardness of about 35 to about 65 Shore D with a thickness of about 0.010 to about 0.25 inches. The urethane can be prepared from one equivalent of MDI/PTMEG polyol 2000 prepolymer having about 6.0 percent NCO, 0.95 equivalent of Ethacure 300, and 3.5% HCC-19584 (a white color dispersion). ETHACURE 300 is commercially available from Albermarle Corporation of Baton Rouge, La. Conventional paints or other color stabilization packages can be applied over the cover of the golf ball. A suitable dimple pattern is a 392 dual dimple icosahedron pattern having a dimple volume of about 590 $mm^3$.

The golf ball of Example 10 can be formed into a wound ball by making the center diameter between about 1.3 and 1.5 inches. A wound layer of polyetherurea thread material can then be formed over the center to form a core of about 1.58 inches or greater in diameter. The inner cover can be compression molded over the windings. The inner cover can include trans-polyisoprene that is amalgamated into the windings to provide a "stiffer" region. The outer cover layer is formed onto the inner cover as described above.

Example 11

A Double Cover Arrangement According to the Invention

Inner and outer covers may formed of ionomers, polyamides, metallocene-catalyzed polymers, amide-esters, ether-esters, thermoset and thermoplastic polyurethanes, or blends thereof by casting, reaction injection molding, injection molding, compression molding, or a combination thereof. The inner cover may have a hardness of about 25 to about 75 Shore D and may have a thickness of about 0.01 to about 0.25 inches. The outer cover may have a hardness of about 35 to about 65 Shore D and may have a thickness of about 0.010 to about 0.25 inches. The inner cover coefficient of friction may differ from the outer cover coefficient of friction by about 0.1 or greater.

Example 12

A Double Cover Arrangement According to the Invention

Inner and outer covers may formed of ionomers, polyamides, metallocene-catalyzed polymers, amide-esters, ether-esters, thermoset and thermoplastic polyurethanes, or belnds thereof by casting, reaction injection molding, injection molding, compression molding, or a combination thereof. The inner cover may have a hardness of about 25 to about 75 Shore D and may have a thickness of about 0.01 to about 0.25 inches. The outer cover may have a hardness of about 35 to about 65 Shore D and may have a thickness of about 0.010 to about 0.25 inches. The inner cover flexural modulus may differ from the outer cover flexural modulus by about 500 psi or greater.

Example 13

A Double Cover Arrangement According to the Invention

Inner and outer covers may formed of ionomers, polyamides, metallocene-catalyzed polymers, amide-esters, ether-esters, thermoset and thermoplastic polyurethanes, or belnds thereof by casting, reaction injection molding, injection molding, compression molding, or a combination thereof. The inner cover may have a hardness of about 25 to about 75 Shore D and may have a thickness of about 0.01 to about 0.25 inches. The outer cover may have a hardness of about 35 to about 65 Shore D and may have a thickness of about 0.010 to about 0.25 inches. The inner cover flexural modulus may differ from the outer cover flexural modulus by about 5,000 psi or less.

Example 14

A Double Cover Arrangement According to the Invention

Inner and outer covers may formed of ionomers, polyamides, metallocene-catalyzed polymers, amide-esters, ether-esters, thermoset and thermoplastic polyurethanes, or belnds thereof by casting, reaction injection molding, injection molding, compression molding, or a combination thereof. The inner cover may have a hardness of about 35 to about 65 Shore D and may have a thickness of about 0.01 to about 0.25 inches. The outer cover may have a hardness of about 35 to about 65 Shore D and may have a thickness of about 0.010 to about 0.25 inches. The inner cover contact angle may differ from the outer cover contact angle by about 1 ° or greater.

While it is apparent that the illustrative embodiments of the invention herein disclosed fulfills the objectives stated above, it will be appreciated that numerous modifications and other embodiments can be devised by those of ordinary skill in the art. For example, the present invention could use more than one thread where the threads are chemically, physically or mechanically distinct from each other. Therefore, it will be understood that the appended claims are intended to cover all such modifications and embodiments which come within the spirit and scope of the present invention.

What is claimed is:

1. A golf ball comprising:

a core;

a cover disposed about the core, consisting essentially of:

an inner cover layer formed from a first composition having a first hardness, a first thickness of about 0.01 inches to about 0.25 inches, and a first flexural modulus;

an outer cover layer disposed on the inner cover formed from a second composition having a second hardness, a second thickness, and a second flexural modulus, wherein the second hardness differs from the first hardness by about 5 points or less, wherein the second thickness is less than the first thickness and from about 0.005 inches to about 0.1 inches, and wherein the second flexural modulus is less than the first flexural modulus.

2. The golf ball of claim 1, wherein the first flexural modulus differs from the second flexural modulus by about 5,000 psi or less.

3. The golf ball of claim 1, wherein the first flexural modulus differs from the second flexural modulus by about 1,000 psi to about 2,500 psi or less.

4. The golf ball of claim 1, wherein the first composition is different than the second composition.

5. The golf ball of claim 4, wherein the first composition comprises a metallocene-catalyzed polymer, a partially neutralized ionomer, a fully neutralized ionomer, or thermoplastic polyester and the second composition comprises a polyurethane, polyurea, silicone, or epoxy.

6. The golf ball of claim 4, wherein the second composition comprises a filler selected from the group consisting of precipitated hydrated silica, clay, talc, asbestos, glass fibers, aramid fibers, mica, calcium metasilicate, barium sulfate, zinc sulfide, lithopone, silicates, silicon carbide, diatomaceous earth, polyvinyl chloride, carbonates, metals, metal alloys, metal oxides, particulate carbonaceous materials, micro balloons, fly ash, and combinations thereof.

7. The golf ball of claim 1, wherein the first and second compositions are substantially similar.

8. The golf ball of claim 1, wherein the second hardness differs from the first hardness by about 3 points or less.

9. The golf ball of claim 1, wherein the second hardness is from about 35 to about 65 Shore D.

* * * * *